United States Patent [19]

Kajiwara et al.

[11] Patent Number: 4,963,466

[45] Date of Patent: Oct. 16, 1990

[54] SILVER HALIDE PHOTOGRAPHIC LIGHT-SENSITIVE MATERIAL SUITABLE FOR RAPID PROCESSES COMPRISING HYDROQUINONE AND AN ANTIFOGGANT

[75] Inventors: Makoto Kajiwara; Masanobu Miyoshi; Kaoru Onodera, all of Odawara; Eiichi Sakamoto, Hino, all of Japan

[73] Assignee: Konishiroku Photo Industry Co., Ltd., Tokyo, Japan

[21] Appl. No.: 469,709

[22] Filed: Jan. 24, 1990

Related U.S. Application Data

[63] Continuation of Ser. No. 325,091, Mar. 15, 1989, abandoned, which is a continuation of Ser. No. 78,870, Jul. 28, 1987, abandoned.

[30] Foreign Application Priority Data

Jul. 31, 1986 [JP] Japan ..... 61-180972

[51] Int. Cl.[5] ..... G03C 7/26; G03C 7/32

[52] U.S. Cl. ..... 430/551; 430/567; 430/607; 430/61 X; 430/613; 430/621; 430/626

[58] Field of Search ..... 430/551, 567, 607, 611, 430/613, 621, 626

[56] References Cited

U.S. PATENT DOCUMENTS

| | | | |
|---|---|---|---|
| 2,843,491 | 7/1958 | Allen et al. | 430/611 |
| 3,700,453 | 10/1972 | Knechel | 430/551 |
| 4,121,939 | 10/1978 | Aoachi et al. | 430/551 |
| 4,269,927 | 5/1981 | Atwell | 430/569 |
| 4,549,015 | 10/1985 | Howell | 430/551 |
| 4,564,591 | 1/1986 | Tanaka et al. | 430/603 |
| 4,587,210 | 5/1986 | Ono et al. | 430/551 |
| 4,618,570 | 10/1986 | Kadowaki et al. | 430/626 |
| 4,623,616 | 11/1986 | Takada et al. | 430/553 |
| 4,631,252 | 12/1986 | Howell | 430/551 |
| 4,661,441 | 4/1987 | Kajiwara et al. | 430/567 |

FOREIGN PATENT DOCUMENTS

| | | | |
|---|---|---|---|
| 0208146 | 1/1987 | European Pat. Off. | 430/607 |
| 2041356 | 9/1980 | United Kingdom | 430/611 |

*Primary Examiner*—Paul R. Michl
*Assistant Examiner*—Patrick Doody
*Attorney, Agent, or Firm*—Jordan B. Bierman

[57] ABSTRACT

A silver halide photographic light-sensitive material comprising a support bearing thereon at least one silver halide emulsion layer containing a dye-forming coupler and a compound represented by Formula [I] as defined in the specification. The light-sensitive material further comprises at least one silver halide emulsion layer containing silver halide grains having a silver chloride content of not less than 90 mole percent and a compound represented by Formula [S] as defined in the specification.

The presence of the compounds of Formula [I] and Formula [S] provide a material having a suitable contrast and having additional advantages such as excellent BF contamination resistance and pH variation resistance.

14 Claims, No Drawings

SILVER HALIDE PHOTOGRAPHIC LIGHT-SENSITIVE MATERIAL SUITABLE FOR RAPID PROCESSES COMPRISING HYDROQUINONE AND AN ANTIFOGGANT

This application is a continuation of application Ser. No. 325,091, filed Mar. 15, 1989, now abandoned, which is a continuation of application Ser. No. 078,870, filed July 28, 1987, now abandoned.

FIELD OF THE INVENTION

This invention relates to a silver halide photographic light-sensitive material and. more particularly, to a silver halide photographic light-sensitive material which is not only endowed with a proper gradation of dye-images formed but also capable of being rapidly processed.

BACKGROUND OF THE INVENTION

In recent years, it has so far been demanded for such a silver halide photographic light-sensitive material as is rapidly processable, excellent in image quality as well as in processing stability, inexpensive in cost and, particularly, applicable to a rapid process.

In general, silver halide photographic light-sensitive materials are usually processed successively with automatic processors installed in every photofinisher. As for one of their service improvements to their customers, the photofinishers have been required to finish up their customers' light-sensitive materials and return to the customers in the very same day when the materials are received from their customers. Recently, the photofinishers are being further required to finish and return within several hours upon receipt of light-sensitive materials, so that the demands for rapid processing services are getting increased. In addition to the above, a rapid processing innovation are urgently demanded from the viewpoint of shortening a processing time so as to improve a production efficiency and to economize the photofinishing costs.

Some approaches have been made to achieve rapid processing techniques from the aspects of both light-sensitive materials and processing liquids. For the color development processes, a high-temperature process, a high pH process, a high concentration of color developing agents and so forth have been tried and it has been well-known that such an additive as a development accelerator is to be added. Such development accelerators include, for example. 1phenyl-3-pyrazolidone described in British Patent No. 811,185, N-methyl-p-aminophenol described in U.S. Pat. No. 2,417,514, N,N,N',N'-tetramethyl-p-phenylenediamine described in Japanese Patent O.P.I. Publication No. 15554/1975 and so forth. In these techniques, however, any satisfactory rapid process may not be expected and, in addition, there may often be some instances where such a deterioration in photographic characteristics as a fog increase may be caused together.

In the meantime, it has been known that, in the silver halide emulsions used in light-sensitive materials, the configurations, sizes and compositions of the silver halide grains thereof greatly influence upon a development time and so forth. It has been well-known, in particular, that the influence of the compositions thereof is relatively greater and, when using a highly chloride-containing silver halide, a remarkably high rate of development may be displayed.

With a silver halide color photographic light-sensitive material, a dye-image may be formed after the light-sensitive material is exposed to light and is then treated in a color development and so forth. However, in a silver halide color photographic light-sensitive material which uses the above-mentioned highly chloride-containing silver halide suitable for a rapid process and contains couplers, there may very often be such an instance where the rate of producing the oxidized products of a color developing agent may become faster than the reaction rate of forming a dye upon coupling of the above-mentioned oxidized products to the couplers. If this is the case, a plenty of the oxidized products of a color developing agent are so present as to cause a color turbidity because of the interlayer migration thereof in the light-sensitive material and so forth, or as to cause the so-called latent-image bleach made by oxidizing a latent image nucleus formed by an exposure to light. Therefore, a light-sensitive material is added by a compound capable of making the excessive oxidized products of a color developing agent harmless upon reacting together, for the purpose of preventing the above-mentioned color turbidity and latent-image bleach. A large quantity of the compound is required to add rather than in the case of not using any highly chloride-containing silver halide. The most effective ones out of such compounds as mentioned above include, for example, hydroquinone derivatives.

When a large quantity of such hydroquinone derivatives were used in the light-sensitive material, there appeared such a phenomenon that the contrast of a dye-image obtained had a seriously hard toe-shape. In silver halide photographic light-sensitive materials, it is a serious problem that a contrast has a too hard toe-shape. In other words, it is very hard to control the gradation in the toe portion of the characteristic curve and, for example, even if an amount of silver coated may be so effectively adjusted as to control the gradation in the shoulder portion, it may display a very little effect on the control of the gradation of the toe portion. Also in a method of mixing monodisperse silver halide emulsions containing different sized silver halide grains together in a suitable proportion, which is often applied for controlling the gradation, a toe portion is hard to be soften. If silver halide emulsions, which are to be mixed, are made so big in grain size difference from each other as much as a toe portion may satisfactorily be softened, a shoulder portion may be so excessively softened that such a light-sensitive material may no longer be suitable for practical use. Such gradation in the toe portion mentioned above will exert the most serious influence upon the graphic description of a silver halide photographic light-sensitive material. If it is too hard, an image obtained will have almost no graphic description, so that the silver halide photographic light-sensitive material will be seriously damaged in its image quality. It becomes, therefore, essential to acquire a technique of suitably softening the gradation in the toe portion.

In general, such silver halide photographic light-sensitive materials are usually processed in succession with replenishing the respective replenishers, in a variety of processing laboratories such as photofinishers. In such a case, it is almost impossible to keep the compositions of each processing liquid constant from the time of starting a series of processing steps up to the latter half thereof. Accordingly, there is a problem that photographic characteristics may be varied with the changes in the composition of processing liquids used. This problem is getting more serious as the low-volume replenishments of processing liquids are getting popularized in recent years.

Especially, it is nearly impossible to completely avoid a bleach-fixer contaminated into a developer, even in the case that a strict rate of replenishing a replenisher is established, an evaporation is protected and any eluate from a light-sensitive material is eliminated. In a roller-transport or an automatic processor in particular, there may be a big difference in an amount of a bleach-fixer contaminated into a developer, according to the quantities of light-sensitive materials processed or various squeezing manners. When the rate of replenishing a processing liquid is lowered, there is actually a further difference in a rate of a bleach-fixer contaminating into a developer, because a rate of circulating the processing liquid is also lowered.

Meanwhile, a color developer is kept at a high pH value though, it cannot be avoided that the pH values of the color developer is varied according to the amounts of a replenisher added, the degrees of the air-oxidation of processing liquids and so forth in continuous operation.

The variations in photographic characteristics including, mostly, a fog increase and the variations in contrasts, are caused by contaminating a bleach-fixer into a color developer or by varying the pH values of a color developer.

Such photographic characteristic variations result in serious troubles to hinder the reproduction of stable and excellent colors and contrasts. By the above-mentioned reasons as well as by reasons that it is very hard to avoid the contamination of a bleach-fixer into a color developer and to prevent a pH variation itself, it has so far demanded to develop a silver halide photographic light-sensitive material that is substantially less in photographic characteristic variation and is excellent in the so-called BF contamination resistance and pH variation resistance even if a bleach-fixer should be contaminated in or a pH value should be varied.

The present inventors have variously studied on the improvements of the hard toe-contrasts of a dye-image which have become a serious problem when using silver halide grains having a high silver chloride content suitable for a rapid processing and a antistaining agent. Resultingly, the present inventors have discovered that the suitable contrast characteristics can be obtained, without affecting any other photographic characteristics, by making use of a specific compounds in combination, so that the present inventors have finally achieved this invention. In addition to the above, the present inventors have also discovered that the silver halide photographic light-sensitive materials using the specific compounds are also endowed with the additional advantages such as the excellent BF contamination resistance and pH variation resistance.

SUMMARY OF THE INVENTION

It is, accordingly, an object of the invention to provide a silver halide photographic light-sensitive material which is applicable to a rapid processing and is excellent in the contrast characteristics of dye-images formed thereon.

Another object of the invention is to provide a silver halide photographic light-sensitive material which is applicable to a rapid processing and is excellent in gradation of dye-images formed thereon and, further, in a BF contamination resistance and a pH variation resistance.

The present invention specifically relates to a silver halide photographic light-sensitive material comprising a support bearing thereon at least one silver halide emulsion layer containing a dye-forming coupler and a compound represented by the following Formula [I], wherein at least one of the above-mentioned silver halide emulsion layers contains silver halide grains having a silver chloride content of not less than 90 mol % and a compound represented by the following Formula [S].

Formula [I]

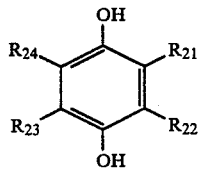

wherein $R_{21}$, $R_{22}$, $R_{23}$ and $R_{24}$ are independently selected from the group consisting of a hydrogen atom, a halogen atom an alkyl group, an alkenyl group, an aryl group, a cycloalkyl group, an alkoxy group, an aryloxy group, an alkylthio group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group, provided, however, that at least one of $R_{21}$ and $R_{23}$ is a group having a total carbon atoms of not less than three.

Formula [S]

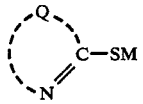

wherein Q represents a group of atoms necessary for completing a 1,3,4-axidiazole ring, a 1,3,4-thiadiazole ring or a 1,3,4-triazine ring; and M represents a hydrogen atom, an alkali metal atom or an ammonium group.

DETAILED DESCRIPTION OF THE INVENTION

In the silver halide photographic light-sensitive materials of the invention, at least one silver halide emulsion layer thereof contains a compound represented by the above-given Formula [S].

In Formula [S], the 1,3,4-oxadiazole ring, 1,3,4-thiadiazole ring and 1,3,5-triazine ring each represented by Q include those having any substitutable substituents. Such substitutable groups include, for example, an alkyl group, an aryl group, an alkenyl group, a cycloalkyl group, a mercapto group, an amino group, an acylamino group, a sulfonamido group, a heterocyclic group and so forth. The alkali metal atoms each represented by M include, for example, a sodium atom, a potassium atom and so forth.

Among the compounds relating to the invention represented by Formula [S], the preferable compounds thereof include, for example, those represented by the following Formula [SA]:

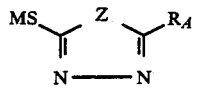

Formula [SA]

wherein Z represents an oxygen atom or a sulfur atom; $R_A$ represents a hydrogen atom, an alkyl group, an aryl group, an alkenyl group, a cycloalkyl group, a $-SR_{A1}$,

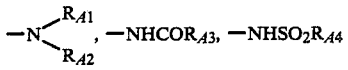

or a heterocyclic group, in which $R_{A1}$ and $R_{A2}$ represent each a hydrogen atom, an alkyl group or an aryl group and $R_{A3}$ and $R_{A4}$ represent each an alkyl group or an aryl group, and M represents a hydrogen atom, an alkali metal atom or an ammonium group.

In Formula [SA], the alkyl groups represented by $R_A$, $R_{A1}$, $R_{A2}$, $R_{A3}$ and $R_{A4}$ each include, for example, a methyl group, a benzyl group, an ethyl group, a propyl group and so forth, and the aryl groups include, for example, a phenyl group, a naphthyl group and so forth.

The alkenyl groups represented by $R_A$ include, for example, a propenyl group and so forth. The cycloalkyl groups represented thereby include, for example, a cyclohexyl group and so forth. The heterocyclic groups represented thereby include, for example, a furyl group, a pyridinyl group and so forth.

The alkyl groups and aryl groups each represented by the above-given $R_A$, $R_{A1}$, $R_{A2}$, $R_{A3}$ and $R_{A4}$ and the alkenyl groups, cycloalkyl groups and heterocyclic groups each represented by the $R_A$ include those having a further substituent.

The alkali metal atoms represented by M include, for example, a potassium atom, a sodium atom and so forth.

The other preferable examples of the compounds relating to the invention represented by the Formula [S] include the compounds represented by the following Formula [SB]:

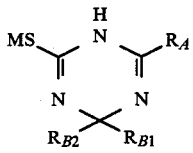

Formula [SB]

wherein $R_A$ and M represent each the groups synonymous with those represented by $R_A$ and M denoted in Formula [SA]; and $R_{B1}$ and $R_{B2}$ represent each the groups synonymous with $R_{A1}$ and $R_{A2}$ denoted in Formula [SA].

The typical examples of the compounds represented by Formula [S] will be given below. It is, however, to be understood that the invention shall not be limited thereto.

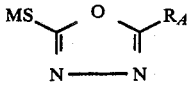

| Exemplified Compound | $R_A$ | M |
|---|---|---|
| S-1 | $-C_2H_5$ | —H |
| S-2 | $-CH_2-CH=CH_2$ | —H |
| S-3 | $-CH=CH-CH_2-CH_3$ | —H |
| S-4 | $-C_7H_{15}$ | —H |
| S-5 | $-C_9H_{19}$ | —Na |
| S-6 | 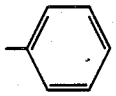 | —H |
| S-7 | $-C_4H_9(t)$ | —H |
| S-8 | 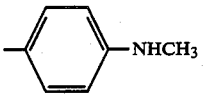 | —H |
| S-9 | 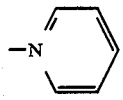 | —H |
| S-10 | 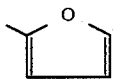 | —H |
| S-11 | 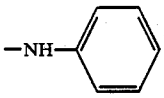 | —H |

-continued
| | | |
|---|---|---|
| S-12 | 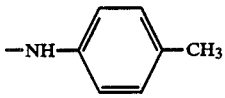 | $-NH_4$ |
| S-13 | $-NHCOCH_3$ | $-H$ |
| S-14 | 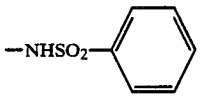 | $-H$ |
| S-15 | $-N(CH_3)_2$ | $-H$ |
| S-16 | 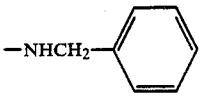 | $-H$ |
| S-17 | 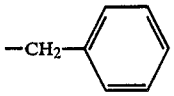 | $-H$ |
| S-18 | $-S-CH_3$ | $-H$ |
| S-19 | 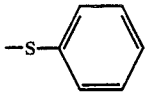 | $-H$ |
| S-20 | $-SH$ | $-H$ |
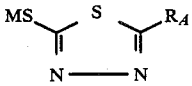
| Exemplified Compound | $R_A$ | M |
|---|---|---|
| S-21 | $-H$ | $-H$ |
| S-22 | $-C_2H_5$ | $-H$ |
| S-23 | $-C_4H_9(t)$ | $-H$ |
| S-24 | $-C_6H_{13}$ | $-H$ |
| S-25 | 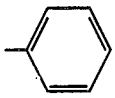 | $-H$ |
| S-26 | 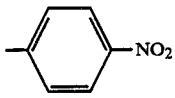 | $-H$ |
| S-27 | 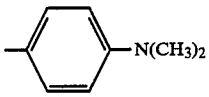 | $-H$ |
| S-28 | 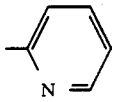 | $-H$ |
| S-29 | 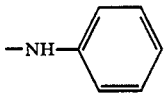 | $-H$ |
| S-30 | $-N(CH_3)_2$ | $-H$ |
| S-31 | $-CH_2CH=CH_2$ | $-H$ |

-continued

| | | |
|---|---|---|
| S-32 | —SH | —H |
| S-33 | —NHCOC$_2$H$_5$ | —H |

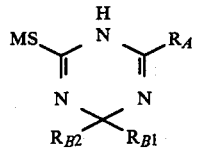

| Exemplified Compound | $R_A$ | $R_{B1}$ | $R_{B2}$ | M |
|---|---|---|---|---|
| S-34 | —C$_2$H$_5$ | —CH$_3$ | —CH$_3$ | —H |
| S-35 | 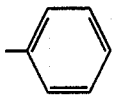 | —CH$_3$ | —CH$_3$ | —H |
| S-36 | —NH$_2$ | —H | 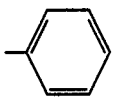 | —H |
| S-37 | 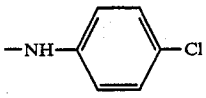 | —H | —C$_4$H$_9$ | —H |
| S-38 | —NHCOCH$_3$ | —CH$_3$ | —CH$_3$ | —H |
| S-39 | 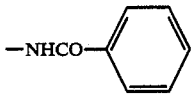 | —CH$_3$ | —CH$_3$ | —H |
| S-40 | 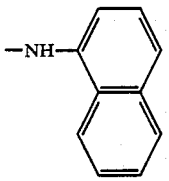 | —CH$_3$ | —C$_3$H$_7$(i) | —H |

Exemplified Compound S-41

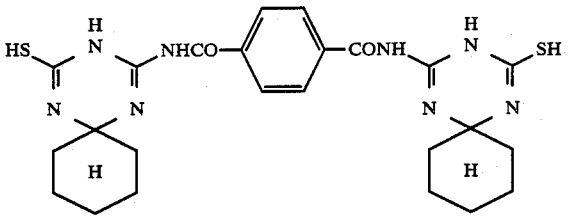

The compounds represented by the above-given Formula [S] include, for example, the compounds described in 'Chemical and Pharmaceutical Bulletin', Tokyo, Vol. 26, No. 314, 1978; Japanese Patent O.P.I. Publication No. 79436/1980; 'Berichte der Deutschen Chemischen Gesellsdraft', Vol. 82, No. 121, 1948; U.S. Pat. Nos. 2,843,491 and 3,017,270; British Pat. No. 940,169; Japanese Patent O.P.I. Publication No. 102639/1976; 'Journal of Americal Chemical Society', No. 44, pp. 1502–1510; and so forth. The synetheses thereof may be carried out in accordance with the processes described in the above-given literatures.

How to contain a compound relating to the invention represented by Formula [S] (hereinafter called a compound [S]) into a silver halide emulsion layer relating to the invention is that a compound [S] is dissolved in water or an organic solvent freely capable of being mixed with water including, for example, methanol, ethanol and the like, and the resulting solution is to be added to the emulsion layer. such a compound [S] may be used independently or in combination with the other compounds represented by Formula [S] or the other stabilizers and antifogging agents than the compounds represented by Formula [S].

The point of time when a compound [S] is to be added may be any point of time, for instance, before forming silver halide grains, in the course of forming the silver halide grains, between the time of completing the silver halide grain formation and the time of commencing a chemical ripening, in the course of chemical ripening, the time of completing the chemical ripening or between the time of completing the chemical ripening and the time of coating. The whole amount of a compound [S] may be added either at a time or separately at several times.

Such a compound [S] may be added either directly to a silver halide emulsion or a silver halide emulsion coating liquid, or to a coating liquid for coating a non-light-sensitive hydrophilic colloidal layer adjacent to a silver halide emulsion layer relating to the invention and therefrom to the silver halide emulsion layer of the invention through a diffusion taken place in a multicoating process.

An amount of such a compound [S] to be added are not particularly limitative, but may ordinarily be within the range of from $1\times10^{-6}$ mol to $1\times10^{-1}$ mol and, more preferably, from $1\times10^{-5}$ mol to $1\times10^{-2}$ mol per mol of the silver halide used.

Some of the compounds [S] relating to the invention have been well-known in the skilled in the art as stabilizers or antifogging agents. They are described in, for example, British Patent No. 1,273,030, Japanese Patent Examined Publication Nos. 9936/1983 and 27010/1985, Japanese Patent O.P.I. Publication Nos. 102639/1976, 22416/1978, 59463/1980, 79436/1980 and 232342/1984, and so forth. In the above-given conventionally known literatures, there are the descriptions of fog inhibiting and emulsion stabilizing techniques. However, there has never been known at all about the effects of the invention that is to improve an image contrast liable to be hardened so as to keep a proper contrast and such hardened image contrast may be produced when color developing a silver halide photographic light-sensitive material containing dye-forming couplers, silver halide grains having a high silver chloride content and an antistaining agent. Such compounds [S] have generally been known as the compounds capable of displaying an antifogging effect and so forth together with desensitizing and development inhibiting effects. (About which is described in, for example, Society of Photographic Science and Technology of Japan, 'Basic Photographic Engineering—Silver Halide Photographic Edition', Corona Publishing Co., 1979, p. 195, and so forth. It is the effect having never been anticipated at all that dye-images liable to be hardened can be improved without affecting any rapid processability and processing stability when applying the above-mentioned compounds to the system of the invention.

In the system of the invention, there also displays the other effects which have been quite beyond the expectation, namely, the so-called BF contamination resistance and pH variation resistance are so excellent that a very stable and excellent reproducibility can be displayed against both of the contamination of a bleach-fixer into a color developer and the variations of photographic characteristics caused according to the pH variations of the color developer, including, for example, a contrast variation and so forth. To be more precise, the compounds represented by Formula [SA] display a relatively greater effect on BF contamination resistance and the compounds represented by Formula [SB] display a relatively greater effect on a pH variation resistance. Out of the compounds represented by Formula [SA], the compounds having Z representing an oxygen atom may be able to display more preferably effects than the compounds having Z representing a sulfur atom may do.

The silver halide emulsion layers having a compound [S] relating to the invention contain silver halide grains having a silver chloride content of not less than 90 mol %.

The silver halide grains of the invention are to have, preferably, a silver chloride content of not less than 90 mol %, a silver bromide content of not more than 10 mol % and a silver iodide content of not more than 0.5 mol % and, more preferably, the silver halide grains are to contain silver chlorobromide having a silver bromide content of from 0.05 to 5 mol %, respectively.

The silver halide grains of the invention may be used either independently or in combination with the other silver halide grains having the different composition. It is also allowed to use the silver halide grains of the invention mixed together with the silver halide grains having a silver chloride content of less than 10 mol %.

In the silver halide emulsion layers each containing the silver halide grains of the invention having a silver chloride content of not less than 90 mol %, a proportion of the silver halide grains having a silver chloride content of not less than 90 mol % to the whole silver halide grains contained in each of the above-mentioned emulsion layers is to be not less than 60% by weight and, more preferably, not less than 80% by weight.

The composition of the silver halide grains of the invention may be either of the uniform all through or of the different between the inside to the outside thereof. When the composition thereof is different between the inside and the outside of the grains, such composition may be varied either continuously or intermittently.

There is no special limitation to the grain sizes of the silver halide grains of the invention. However, taking the other photographic characteristics such as a rapid processability, a sensitivity and so forth into consideration, the grain sizes are to be within the range of, preferably, from 0.2 to 1.6 μm and, more preferably, from 0.25 to 1.2 μm.

The above-mentioned grain sizes may be measured in a variety of methods having popularly been applied in the fields skilled in the art. Typical methods include those described in, for example, R. P. Loveland, 'Particle-Size Measurement', ASTM Symp. on Light Microscopy, 1955, pp. 94–122; or C. E. K. Mees and T. H. James, 'The Theory of the Photographic Process', 3rd Ed., The Macmillan Co., 1966, Chap. 2.

The above-mentioned grain sizes may be measured in terms of a projective area of a grain or an approximate diameter thereof. When every grain has a substantially uniform configuration, the accurate grain size distribution thereof may considerably be expressed in terms of a diameter or projective area of the grains.

In the silver halide grains of the invention, the grain size distribution may be either of the polydisperse type or of the monodisperse type. Among them, the preferable silver halide grains of the invention are of the monodisperse type, which have a variation coefficient of the grain size distribution of not more than 0.22 and, more preferably, of not more than 0.15. The above-mentioned variation coefficient means a coefficient expressing a spreading area of a grain size distribution and such variation coefficient can be defined by the following equations:

Variation coefficient $(S/r)$ =

-continued $$\frac{\text{Std. deviation of grain size distribution}}{\text{Average grain size}}$$

$$\text{Std. deviation of grain size distribution } (S) = \sqrt{\frac{\Sigma(r - ri)^2 ni}{\Sigma ni}}$$

$$\text{Average grain size } (r) = \frac{\Sigma niri}{\Sigma ni}$$

wherein ri represents the grain sizes of individual grains and ni represents the number of the individual grains.

The term, grain size, mentioned herein means a diameter of a grain in the case of globular-shaped silver halide grains, and a diameter of a circular image obtained by converting the projected image of the grain into the circular image having the same area with the area of the projected image in the case of a cubic or any other shaped grain than the globular-shaped.

The silver halide grains used in the emulsions of the invention may be those prepared in any one of an acid process, a neutral process and an ammonia process. Such grains may be grown up either at a time or after preparing seed grains. The respective processes of preparing and growing such seed grains may be the same with or different from each other.

The processes of reacting a soluble silver salt with a soluble halide may be freely selected from a normal, reverse and double-jet precipitation processes and the combination processes thereof. Among the processes, it is preferred to apply the double-jet precipitation process. In addition to the above, it is also allowed to apply such a version of the double-jet precipitation processes as a pAg-controlled double-jet process described in, for example, Japanese Patent O.P.I. Publication No. 48521/1979 and so forth.

It is also allowed to use such a silver halide solvent as thioether and so forth, if further required.

It is also allowed to use therein any configurations of the silver halide grains relating to the invention. One of the preferable examples of their configurations is a cubic having a {100} plane as the crystal face thereof.

It is also allowed to use grains each having an octahedron, tetradecahedron, dodecahedron or the like prepared in such a process as described in. for example. U.S. Pat. Nos. 4,183,756 and 4,225,666; Japanese Patent O.P.I. Publication No. 26589/1980; Japanese Patent Examined Publication No. 42737/1980; 'The Journal of Photographic Science', 21, 39, 1973; and so forth. Further, a grain having a twin-crystal face may be used therein.

As for the silver halide grains relating to the invention, either of those having a uniform configuration or those mixed therein with grains having a variety of configurations may be used.

In the course of forming or growing the silver halide grains to be used in the emulsions of the invention, such grains are allowed to contain metal ions thereinside or on the surfaces thereof by making use of a cadmium salt, a zinc salt, a thalium salt, an iridium salt, or the complex salts thereof, a rhodium salt or the complex salts thereof, an iron salt or the complex salts thereof. Also, a reduction-sensitization speck may be provided to the inside and/or surface of grains by placing the grains in a suitable reduction atmosphere.

From the emulsions containing the silver halide grains of the invention (hereinafter called the emulsion of the invention), unnecessary soluble salts may be removed after completing the growth of the silver halide grains or may be held therein as they are. When removing such unnecessary salts, such removal may be carried out in accordance with the method described in,for example, 'Research Disclosure', No. 17643.

The silver halide grains which are to be used in the emulsions of the invention may be of the types of forming a latent image mainly either on the surfaces of the grains or inside thereof. The preferable grains are of the former type.

The emulsions of the invention may be chemically sensitized in an ordinary process. Namely, there are allowed to use the sensitization processes, independently or in combination, including, for example, a sulfur sensitization process in which a compounds or an active gelatin that contains sulfur and is capable of reacting with silver ions; a selenium sensitization process in which a selenium compound is used; a reduction sensitization process in which a reducible substance is used; a noble metal sensitization process in which a gold or other noble metal compound is used; and so forth.

In the invention, the chemical sensitizers such as a chalcogen sensitizer may be used. 'Chalcogen sensitizer' is a general term for sulfur sensitizers, selenium sensitizers and tellurium sensitizers. As far as those for photographic use are concerned, the sulfur or selenium sensitizers may preferably be used. Such sulfur sensitizers include, for example a thiosulfate, an allylthiocarbazide, a thio urea. allylisothiocyanate, a cystine, a p-toluenethiosulfonate and a rhodanine. Besides the above, there may also be used such a sulfur sensitizer as those described in, for example, U.S. Pat. Nos. 1,574,944, 2,410,689, 2,278,947, 2,728,668, 3,501,313 and 3,656,955; West German Patent (OLS) Publication No. 1,422,869; Japanese Patent O.P.I. Publication Nos. 24937/1981 and 45016/1980; and so forth. An amount of such sulfur sensitizers to be added is varied extensively over to a considerably wide range, depending upon the various conditions such as the sizes of silver halide grains and so forth. As for the criterion, the amount added is preferably within the order of from $10^{-7}$ mol to $10^{-1}$ mole per mol of the silver halide used.

In place of the above-mentioned sulfur sensitizers, a selenium sensitizer may also be used therein. Such selenium sensitizers include, for example, alphatic isoselenocyanates such as an allylisoselenocyanate; selenoureas; selenoketones; selenamides; selenocarboxylates and the esters thereof; selenophosphates; and selenides such as a diethyl selenide, a diethyl diselenide and so forth. The typical examples thereof are given in U.S. Pat. Nos. 1,574,944, 1,602,592 and 1,623,499.

Further, a reduction sensitizer may be used. There is no special limitation thereto, however, such reducing agents include, for example, a stannous chloride, a thiourea dioxide, a hydrazine, a polyamine and so forth.

The noble metal compounds other than the gold compounds, such as a palladium compound and so forth, may also be used in combination.

It is preferred that the silver halide grains relating to the invention are to contain a gold compound. The gold compounds preferably used in the invention may be those having a gold oxidation number of either +monovalency or +tervalency, and a variety of gold compounds may be used.

The typical examples thereof include a potassium chloroaurate, an auric trichloride, a potassium auric thiocyanate, a potassium iodoaurate, a tetracyanauric azide, an ammonium aurocyanate, a pyridyltrichlorogold, a gold sulfide, a gold selenide and so forth.

The gold compounds may be so used either as to sensitize silver halide grains or as not to substantially contribute to any sensitization.

An amount of the gold compounds to be added therein depend upon a variety of conditions applied. As for the criterion, they may be added in an amount of from $10^{-8}$ mol to $10^{-1}$ mol and, preferably, from $10^{-7}$ mol to $10^{-2}$ mol per mole of the silver halide used. The points of time when adding the above-mentioned compounds may be at any time of forming silver halide grains, physical ripening, chemical ripening or after completing the chemical ripening.

The emulsions of the invention may be spectrally sensitized to any desired wavelength region by making use of a spectral sensitizer which has been well-known in the photographic industry. The spectral sensitizers may be used independently or in combination.

The emulsions of the invention are also allowed to contain not only the above-mentioned spectral sensitizers but also a dye not having any spectral sensitizing function in itself or a super-sensitizer which is a compound substantially incapable of absorbing any visible rays of light but is capable of reinforcing the sensitizing function of the spectral sensitizer used.

The silver halide emulsion layers of the invention are to contain the compounds represented by the following Formula [I]:

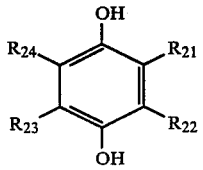

Formula [I]

In the compounds represented by the above-given Formula, $R_{21}$, $R_{22}$, $R_{23}$ and $R_{24}$ represent each a hydrogen atom, a halogen atom, an alkyl group, an alkenyl group, an aryl group, a cycloalkyl group, an alkoxy group, an aryloxy group, an alkylthio group, an arylthio group, an acyl group, an alkylacylamino group, an arylacylamino group, an alkylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group. In the atoms or the groups each represented by $R_{21}$, $R_{22}$, $R_{23}$ and $R_{24}$, the halogen atoms include, for example, a fluorine atom, a chlorine atom and a bromine atom; and the alkyl groups include for example, a methly, ethyl, n-propyl. i-propyl, n-butyl, t-butyl, n-amyl, i-amyl, n-octyl, n-dodecyl, n-octadecyl and the like groups, and the particularly preferable alkyl groups are those each having 1 to 32 carbon atoms.

The alkenyl groups include, for example, an allyl, octenyl, oleyl and the like groups, and the particularly preferable alkenyl groups are those each having 2 to 32 carbon atoms.

The aryl groups include, for example, a phenyl, naphthyl and the like groups.

The acyl groups include, for example, an acetyl octanoyl, lauroyl and the like groups.

The cycloalkyl groups include, for example, a cyclohexyl, cyclopentyl and the like groups.

The alkoxy groups include, for example, a methoxy, ethoxy, dodecyloxy and the like groups; the aryloxy groups include, for example, a phenoxy and the like groups; the alkylthio groups include, for example, a methylthio, n-butylthio, n-dodecylthio and the like groups; the arylthio groups include, for example, a phenylthio and the like groups; the alkylacylamino groups include, for example, an acetylamino and the like groups; the arylacylamino groups include, for example, a benzoylamino and the like groups; the alkylcarbamoyl groups include, for example, a methylcarbamoyl and the like groups; the arylcarbamoyl groups include, for example, a phenylcarbamoyl and the like groups; the alkylsulfonamido groups include, for example, a methylsulfonamido and the like groups; the arylsulfonamido groups include, for example, a phenylsulfonamido and the like groups; the alkylsulfamoyl groups include, for example, a methylsulfamoyl and the like groups; the arylsulfamoyl groups include, for example, a phenylsulfamoyl and the like groups; the alkylsulfonyl groups include, for example, a methylsulfonyl and the like groups; the arylsulfonyl groups include, for example, a phenylsulfonyl and the like groups; the alkyloxycarbonyl groups include, for example, a methyloxycarbonyl and the like groups; the aryloxycarbonyl groups include, for example, a phenyloxycarbonyl and the like groups; the alkylacyloxy groups include, for example, an acetyloxy and the like groups; and the arylacyloxy groups include, for example, a benzoyloxy and the like groups.

The above-mentioned groups include those each having a substituent. Such substituents include, for example, an alkyl, aryl, aryloxy, alkylthio, cyano, acyloxy, alkoxycarbonyl, acyl. sulfamoyl, hydroxy, nitro, amino, heterocyclic and the like groups.

At least one group out of the groups represented by $R_{21}$ and $R_{23}$ is to have not less than 3 carbon atoms in total including the carbon atoms of the substituent thereof given above.

Out of the compounds which are to be used in the invention and are represented by the foregoing Formula [I], in particular, the compounds represented by the following Formulas II] and [III] may preferably be used in the invention.

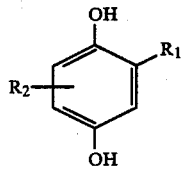

Formula [II]

wherein $R_1$ and $R_2$ represent each an alkyl group such as butyl, pentyl, octyl and the like groups, an aryl group such as a phenyl and the like groups, an alkenyl group such as a propenyl butenyl and the like groups, a cycloalkyl group such as a cyclohexyl and the like groups, or a heterocyclic group such as a cumarone and the like. The above-mentioned groups include those each having a substituent. Such substituents include, for example, an alkyl, aryl and the like groups.

Formula [III]

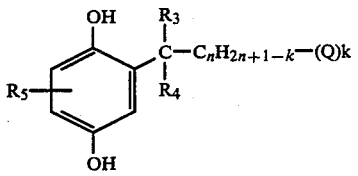

wherein $R_3$ and $R_4$ represent each an alkyl group having 1 to 5 carbon atoms, such as a methyl, propyl, pentyl and the like groups; $R_5$ represents an alkyl group such as a methyl, pentyl, dodecyl and the like groups, an aryl group such as a phenyl and the like group, an alkenyl group such as a propenyl, butenyl and the like groups, a cycloalkyl group such as a cyclohexyl and the like groups, a heterocyclic group such as a cumarone and the like groups, or

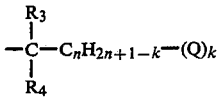

wherein n is an integer of from 1 to 20; k is an integer of 1 or 2: and Q represents —$COXR_6$ in which X represents an oxygen atom or

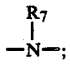

$R_6$ represents a hydrogen atom, an alkyl group such as a methyl, hexyl, dodecyl and the like groups, an alkenyl group such as a propenyl and the like groups, a cycloalkyl group such as a cyclohexyl and the like groups or an aryl group such as a phenyl and the like groups; $R_7$ represents a hydrogen atom, an alkyl group such as a methyl and the like groups, or an aryl group such as a phenyl and the like groups; and each of the above-mentioned groups include those having a substituent; and Q also represents —OY in which Y represents —$R_6$ or —$COR_6$,

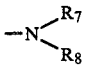

in which $R_8$ represents a hydrogen atom, an alkyl group, an aryl group or —$COR_6$, —$P(O)(OR_6)([O]/R_9)$ in which $R_9$ is synonymous with $R_6$ and l is an integer of 0 or 1, or a cyano group.

Next, the typical examples of the compounds represented by Formula [I] will be given below:

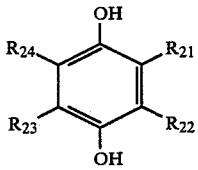

| Exemplified Compound No. | $R_{21}$ | $R_{22}$ | $R_{23}$ | $R_{24}$ |
|---|---|---|---|---|
| 1 | —$C_4H_9$(t) | —H | —$C_4H_9$(t) | —H |
| 2 | —$C_5H_{11}$(t) | —H | —$C_5H_{11}$(t) | —H |
| 3 | —C(CH$_3$)$_2$—$C_3H_7$ | —H | —C(CH$_3$)$_2$—$C_3H_7$ | —H |
| 4 | —$C_8H_{17}$(t) | —H | —$C_8H_{17}$(t) | —H |
| 5 | —$C_8H_{17}$(sec) | —H | —$C_8H_{17}$(sec) | —H |
| 6 | —$C_{12}H_{25}$(sec) | —H | —$C_{12}H_{25}$(sec) | —H |
| 7 | —$C_{12}H_{25}$(t) | —H | —$C_{12}H_{25}$(t) | —H |
| 8 | —$C_{16}H_{33}$(sec) | —H | —$C_{16}H_{33}$(sec) | —H |
| 9 | —$C_{18}H_{37}$(sec) | —H | —$C_{18}H_{37}$(sec) | —H |
| 10 | —$C_{16}H_{33}$(sec) | —H | —$CH_3$ | —H |
| 11 | —$C_{18}H_{37}$(sec) | —H | —$CH_3$ | —H |
| 12 | —C(CH$_3$)$_2$—C$_6$H$_5$ | —H | —C(CH$_3$)$_2$—C$_6$H$_5$ | —H |
| 13 | —C(CH$_3$)$_2$—(CH$_2$)$_3$—CH(CH$_3$)$_2$ | —H | —C(CH$_3$)(C$_2$H$_5$)—(CH$_2$)$_3$—CH(CH$_3$)$_2$ | —H |
| 14 | —C(CH$_3$)(C$_2$H$_5$)—(CH$_2$)$_3$—CH(CH$_3$)$_2$ | —H | —C(CH$_3$)(C$_2$H$_5$)—(CH$_2$)$_3$—CH(CH$_3$)$_2$ | —H |
| 15 | —$C_8H_{17}$(sec) | —H | —$C_4H_9$(t) | —H |

-continued
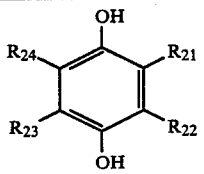
| Exemplified Compound No. | $R_{21}$ | $R_{22}$ | $R_{23}$ | $R_{24}$ |
|---|---|---|---|---|
| 16 | $-C_{16}H_{33}$(sec) | —H | —H | —H |
| 17 | $-C_8H_{17}$(sec) | —H | $-CH_3$ | —H |
| 18 | $-C_{18}H_{37}$(sec) | —H | $-C_4H_9$(t) | —H |
| 19 | $-C_{14}H_{29}$(sec) | —H | $-C_4H_9$(t) | —H |
| 20 | $-C_{16}H_{33}$(sec) | —H | $-C_4H_9$(t) | —H |
| 21 | $-C_{12}H_{25}$(n) | —H | $-C_4H_9$(t) | —H |
| 22 | $-NHCOC_{17}H_{35}$(n) | —H | —H | —H |
| 23 | $-C_8H_{17}$(t) | —H | $-C_4H_9$(t) | —H |
| 24 | 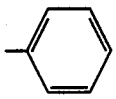 | —H | 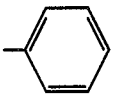 | —H |
| 25 | 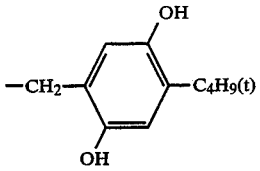 | —H | $-C_4H_9$(t) | —H |
| 26 | 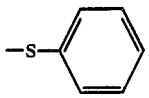 | —H | 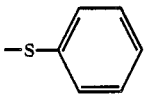 | —H |
| 27 | 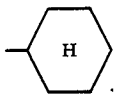 | —H | 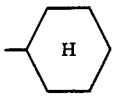 | —H |
| 28 | $-(CH_2)_4CH{=}CH_2$ | —H | $-(CH_2)_2CH{=}CH_2$ | —H |
| 29 | $-C_8H_{17}$(t) | —H | $-CH_3$ | $-CH_3$ |
| 30 | $-CH_2CONHC_{12}H_{25}$(n) | —H | $-CH_2CONHC_{12}H_{25}$(n) | —H |
| 31 | $-OCH_3$ | —H | $-C_8H_{17}$(t) | —H |
| 32 | 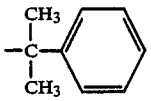 | —H | $-CH_3$ | —H |
| 33 | 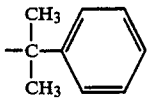 | —H | 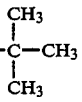 | —H |
| 34 | 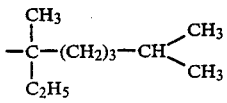 | —H | 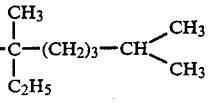 | —H |
| 35 | 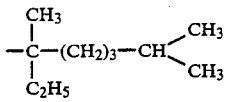 | —H | —H | —H |
| 36 | —Cl | —Br | $-C_{15}H_{31}$(n) | —H |

-continued
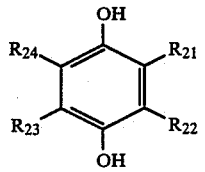
| Exemplified Compound No. | $R_{21}$ | $R_{22}$ | $R_{23}$ | $R_{24}$ |
|---|---|---|---|---|
| 37 | 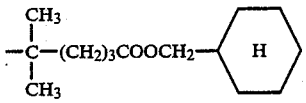 | —H | 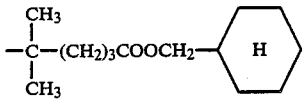 | —H |
| 38 | 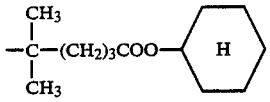 | —H | 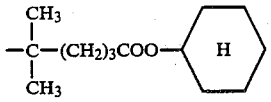 | —H |
| 39 | $-C(CH_3)_2-(CH_2)_3COOC_{12}H_{25}(n)$ | —H | $-C(CH_3)_2-(CH_2)_3COOC_{12}H_{25}(n)$ | —H |
| 40 | $-C(CH_3)_2-(CH_2)_3-CH(CH_3)_2$ | —H | $-C(CH_3)_2-(CH_2)_3-CH(CH_3)_2$ | —H |
| 41 | $-C(CH_3)_2-(CH_2)_3COOC_6H_{13}(n)$ | —H | $-C(CH_3)_2-(CH_2)_3COOC_6H_{13}(n)$ | —H |
| 42 | $-C(CH_3)_2-(CH_2)_3COOCH_2CH(C_2H_5)C_4H_9$ | —H | $-C(CH_3)_2-(CH_2)_3COOCH_2CH(C_2H_5)C_4H_9$ | —H |
| 43 | 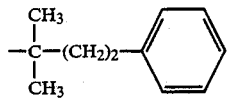 | —H | 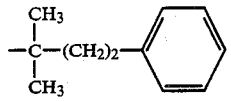 | —H |
| 44 | 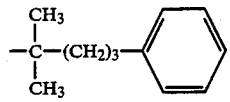 | —H | 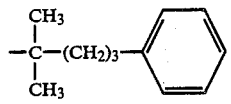 | —H |
| 45 | 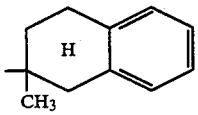 | —H | 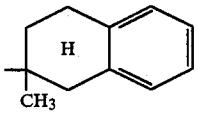 | —H |
| 46 | 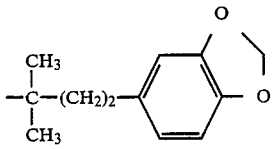 | —H | 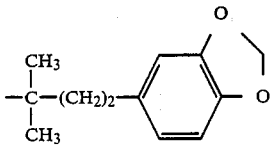 | —H |
| 47 | $-C(CH_3)_2-(CH_2)_3-Cl$ | —H | $-C(CH_3)_2-(CH_2)_3-Cl$ | —H |

-continued

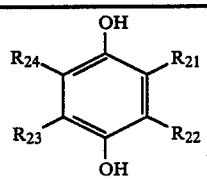

| Exemplified Compound No. | $R_{21}$ | $R_{22}$ | $R_{23}$ | $R_{24}$ |
|---|---|---|---|---|
| 48 | $-C(CH_3)_2-(CH_2)_3-S-C_4H_9(n)$ | —H | $-C(CH_3)_2-(CH_2)_3-S-C_4H_9(n)$ | —H |

The hydroquinone derivatives relating to the invention represented by Formula [I] may be added in any amount within the range of from $1\times10^{-3}$ mol to 1 mol per mol of the couplers used and, more preferably, in an amount within the range of from $5\times10^{-3}$ mol to 0.5 mol from the viewpoint of efficiency. The hydroquinone derivatives relating to the invention is to be added into a silver halide emulsion layer containing couplers. However, they may also be added, without trouble, into the layers adjacent to the emulsion layer.

The above-mentioned hydroquinone derivatives have so far been known as an antistaining agent and are described in, for example, Research Disclosure, No. 176, 1978, Article 17643, VII-I, Japanese Patent O.P.I. Publication Nos. 24141/1983, 180557/1984 and 189342/1984, and so forth.

To the silver halide emulsion layers of the silver halide photographic light-sensitive materials of the invention, a dye-forming coupler may be applied.

It is preferred that such dye-forming couplers are to contain, in the molecules thereof, a group having not less than 8 carbon atoms capable of making a coupler so-called a ballast group not dispersive.

As for the yellow dye-forming couplers, acylacetanilide type couplers may preferably be used. Out of these couplers, benzoylacetanilide or pivaloylacetanilide type compounds are advantageously be used. The preferable compounds are represented by the following Formula [Y]:

Formula [Y]

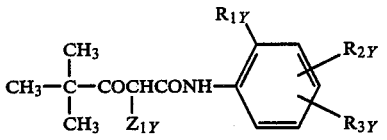

wherein $R_{1Y}$ represents a halogen atom or an alkoxy group; $R_{2Y}$ represents a hydrogen atom, a halogen atom or an alkoxy group; $R_{3Y}$ represents an acylamino group, an alkoxycarbonyl group, an alkylsulfamoyl group, an arylsulfamoyl group, an arylsulfonamido group, an alkylureido group, an arylureido group, a succinimido group, an alkoxy group or an aryloxy group; and $Z_{1Y}$ represents a group capable of splitting off upon coupling to the oxidized product of a color developing agent.

The typical examples of the yellow couplers which may be used are those described in British Patent No. 1,077,874; Japanese Patent Examined Publication No. 40757/1970; Japanese Patent O.P.I. Publication Nos. 1031/1972, 26133/1972, 94432/1973, 87650/1975, 3631/1976, 115219/1977, 99433/1979, 133329/1979 and 30127/1981; U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752; and so forth.

As for the magenta dye-forming couplers, 5-pyrazolone type couplers, pyrazoloazole type couplers and so forth may preferably be used. More preferable couplers are represented by the following formula [P] or [a]:

Formula [P]

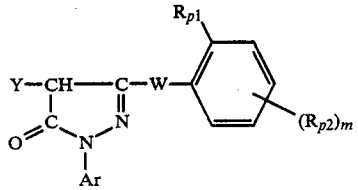

wherein Ar represents an aryl group; $R_{p1}$ represents a hydrogen atom or a substituent; $R_{p2}$ represents a substituent; Y represents a hydrogen atom or a group capable of splitting off upon reaction with the oxidized product of a color developing agent; W represents —NH—, —NHCO— in which N atom is to couple to a carbon atom of a pyrazolone nucleus, or —NHCONH—; and m is an integer of 1 or 2.

Formula [a]

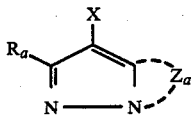

wherein Za represents a group of atoms necessary for completing a nitrogen-containing heterocyclic ring, provided that the ring completed with Za is allowed to have a substituent;

X represents a hydrogen atom or a group capable of splitting off upon reaction with the oxidized product of a color developing agent; and Ra represents a hydrogen atom or a substituent.

The substituents represented by Ra include, for example, a halogen atom, an alkyl group a cycloalkyl group, an alkenyl group, a cycloalkenyl group, an alkinyl group, an aryl group, a heterocyclic group, an acyl group, a sulfonyl group, a sulfinyl group, a sulfonyl group, a carbamoyl group, a sulfamoyl group, a cyano group, a spiro-compound residual group, an organic hydrocarbon compound residual group, an alkoxy group, an aryloxy group, a heterocyclic oxy group, a siloxy group, an acyloxy group, a carbamoyloxy group, amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The above-mentioned couplers are described in, for example. U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,390,861, 3,930,866 and 3,933,500; Japanese Patent O.P.I. Publication Nos. 29639/1974, 111631/1974, 129538/1974, 13041/1975, 58922/1977, 62454/1980, 118034/1980, 38043/1981, 35858/1982 and 23855/1985; British Patent No. 1,247,493; Belgian Patent Nos. 769,116 and 792,525; West German Patent No. 2,156,111; Japanese Patent Examined Publication No. 60479/1971; Japanese Patent O.P.I. Publication Nos. 125732/1984, 228252/1984, 162548/1984, 171956/1984, 33552/1985 and 43659/1985; West German Patent No. 1,070,030; U.S. Pat. No. 3,725,067; and so forth.

As for the cyan dye-forming couplers, phenol type or naphthol type cyan dye-forming couplers may be used. Out of these couplers, the couplers represented by the following formula [E] or [F] may preferably be used.

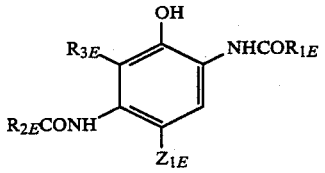

Formula [E]

wherein $R_{1E}$ represents an aryl group, a cycloalkyl group or a heterocyclic group; $R_{2E}$ represents an alkyl group or a phenyl group; $R_{3E}$ represents a hydrogen atom, a halogen atom, an alkyl group or an alkoxy group; and $Z_{1E}$ represents a hydrogen atom or a group capable of splitting off upon reaction with the oxidized product of an aromatic primary amine type color developing agent.

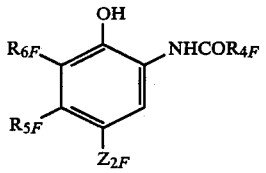

Formula [F]

wherein $R_{4F}$ represents an alkyl group such as a methyl group, an ethyl group, a propyl group, a butyl group, a nonyl group and so forth; $R_{5F}$ represents an alkyl group such as a methyl group, an ethyl group and so forth; $R_{6F}$ represents a hydrogen atom, a halogen atom such as a fluorine atom, a chlorine atom, a bromine atom and so forth, or an alkyl group such as a methyl group, an ethyl group and so forth; and $R_{2F}$ represents a hydrogen atom or a group capable of splitting off upon reaction with the oxidized product of an aromatic primary amine type color developing agent.

The above-mentioned cyan dye-forming couplers are described in, for example, U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, and 3,839,044; British Patent Nos. 478,991, 945,542, 1,084,480, 1,377,233, 1,388,024 and 1,543,040; Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984 and 117249/1985; and so forth.

Ordinarily in a silver halide emulsion layer, the dye-forming couplers applicable to the invention may be used in an amount within the range of from $1\times10^{-3}$ mol to 1 mol and, more preferably, from $1\times10^{-2}$ mol to $8\times10^{-1}$ mol per mol of the silver halide used.

The above-mentioned dye-forming couplers may be added into an objective hydrophilic colloidal layer in such a manner that the couplers are dissolved in a high boiling organic solvent having a boiling point of about not lower than 150° C. and, if required, in combinationa with a low boiling and/or water-soluble organic solvent and the resulted solution is dispersed in such a hydrophilic binder as an aqueous gelatin solution so as to be emulsified by making use of a surface active agent and the resulted emulsion may be added on the objective hydrophilic colloidal layer. It is also allowed to insert a step of removing the low boiling organic solvent after or together with the dispersion step.

The high boiling organic solvents which may be used in the invention include, for example, esters such as a phthalate, a phosphate and so forth, organic acid amides, ketones, hydrocarbon compounds and so forth.

The silver halide photographic light-sensitive materials of the invention may be used for a color negative film, a color positive film and a color print paper, for example. The effects of the processes of the invention can be more particularly be displayed when they are used for a color print paper for directly appreciating a photograph.

The silver halide photographic light-sensitive materials typically including the above-mentioned color print papers may be either of the monochromic or multicolor type. In the case of the multicolor silver halide photographic light-sensitive materials, for the purpose of performing a subtractive color reproduction, they usually have such a structure that the support thereof is laminated thereon in a suitable layer arrangement with some suitable number of both non-light-sensitive layers and silver halide emulsion layers respectively containing magenta, yellow and cyan couplers to serve as photographic couplers. Such layer numbers and arrangements may suitably be changed to meet the purposes of using such light-sensitive materials.

In the case of a multicolor silver halide photographic light-sensitive material of the invention, the particularly preferable layer arrangement thereof is that a yellow-dye-image forming layer, an interlayer, a magenta-dye-forming layer, an interlayer, a cyan-dye-image forming layer, an interlayer and a protective layer are arranged respectively over to and in order from the support of the light-sensitive material.

As for the binders or protective colloids which may be used in the silver halide light-sensitive materials of the invention, gelatins may advantageously be used and, besides the gelatins, there may also be used a gelatin derivative, each graft polymer of gelatins and other macromolecular substances, a protein, a sugar derivative, a cellulose derivative, and hydrophilic colloids including, for example, a monomeric or polymeric synthetic hydrophilic macromolecular substance.

The photographic emulsion layers and other hydrophilic colloidal layers of the silver halide photographic light-sensitive materials of the invention may be hardened by making use, independently or combinedly, a hardening agent which cross-links binder or protective colloids to each other and reinforces the layer strength. It is desired to add such hardening agent so as not to necessarily add any more hardening agents into a processing liquid but to satisfactorily harden the layers. It is, however, allowed to add a hardening agent into processing liquids.

For satisfactorily hardening a silver halide emulsion layer in the invention, it is preferable to use the chlorotriazine type hardening agents represented by the following formula [HDA] or [HDB]:

Formula [HDA]

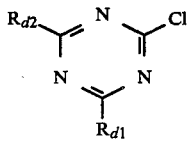

wherein $R_{d1}$ represents a chlorine atom, a hydroxy group, an alkyl group, an alkoxy group, an alkylthio group, an —OM group in which M represents a monovalent metal atom, an —NR'R" group in which R' and R" represent each a hydrogen atom, an alkyl group or an aryl group, or an —NHCOR''' group in which R''' represents a hydrogen atom, an alkyl group or an aryl group; and $R_{d2}$ represents a group synonymous with the above-mentioned $R_{d1}$, except a chlorine atom.

Formula [HDB]

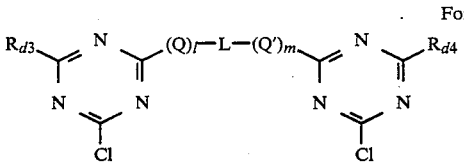

wherein $R_{d3}$ and $R_{d4}$ represent each a chlorine atom, a hydroxy group, an alkyl group, an alkoxy group or an —OM group in which M represents a monovalent metal atom; Q and Q' represent each a bonding group indicating —O—, —S— or —NH—; L represents an alkylene group or an arylene group; and p and q are an integer of 0 or 1.

Next, the typical examples of the preferable hardening agents represented by the above-given formulas [HDA] and [HDB] will be given below:

Formula [HDA]

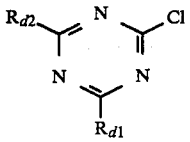

| Compound No. | $R_{d1}$ | $R_{d2}$ |
|---|---|---|
| HD-1 | —OH | —ONa |
| HD-2 | —Cl | —ONa |
| HD-3 | —$OCH_3$ | —ONa |
| HD-4 | —Cl | —$OC_2H_5$ |
| HD-5 | —Cl | —OK |
| HD-6 | —OH | —OK |
| HD-7 | —Cl | —$NH_2$ |
| HD-8 | —Cl | —NHCOCH3 |
| HD-9 | —OH | —$NHC_2H_5$ |

Formula [HDB]

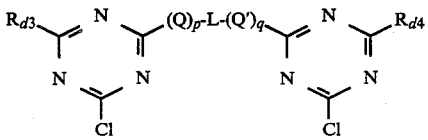

| Compound No. | $R_{d3}$ | $R_{d4}$ | Q | p | Q' | q | L |
|---|---|---|---|---|---|---|---|
| HD-10 | —Cl | —Cl | 0 | 1 | 0 | 1 | 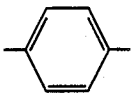 |
| HD-11 | —ONa | —ONa | 0 | 1 | 0 | 1 | —$CH_2CH_2$— |
| HD-12 | —ONa | —ONa | — | 0 | — | 0 | —$CH_2CH_2$— |
| HD-13 | —OCH3 | —OCH3 | S | 1 | S | 1 | —$CH_2CH_2$— |
| HD-14 | —ONa | —ONa | H —N— | 1 | H —N— | 1 | —$CH_2CH_2$— |
| HD-15 | —ONa | —ONa | H —N— | 1 | 0 | 1 | —$CH_2CH_2$— |

The hardening agents represented by the formula [HDA] or [HDB] may be added into silver halide emulsion layers and other component layers in such a manner that the hardening agent is dissolved in water or water-miscible solvent such as methanol, ethanol and so forth and the resulted solution is added into the coating liquids for the above-mentioned component layers. As for the methods of adding such hardening agents, either of a batch adding method and an in-line adding method are applicable. There is no special limilation to the points of time of adding such hardening agents and it is, however, preferable to add them immediately before coating.

These hardening agents may be added in an amount of from 0.5 to 100 mg and, more preferably, from 2.0 to 50 mg per g of gelatin to be coated.

In the silver halide photographic light-sensitive materials of the invention, a plasticizer may also be added with the purpose of increasing the softness of the silver halide emulsion layers and/or other hydrophilic colloidal layers.

In the silver halide photographic light-sensitive materials of the invention, the photographic emulsion layers and other hydrophilic colloidal layers thereof are allowed to contain a water-insoluble or hardly soluble synthetic polymer dispersion, i.e., a latex, with the purposes of improving the dimensional stability and so forth.

In the silver halide photographic light-sensitive materials of the invention, an image stabilizer may be used with the purpose of preventing a dye image from deteriorating.

In the silver halide photographic light-sensitive materials of the invention, the hydrophilic colloidal layers, such as the protective layers, interlayers and so forth, are allowed to contain a UV absorbing agent, with the purposes of preventing a fog produced by a discharge of frictional charge or the like and also preventing an image deterioration caused by UV rays.

The silver halide photographic light-sensitive materials of the invention may be provided with auxiliary layers such as a filter layer, an antihalation layer, an antiirradiation layer and/or the like layers. These layers and/or emulsion layers are also allowed to contain thereinside such a dye as is extravasated from a color light-sensitive material or is bleached, in the course of a development process.

In the silver halide photographic light-sensitive materials of the invention, the silver halide emulsion layers and/or other hydrophilic colloidal layers thereof are allowed to contain a matting agent, with the purposes of reducing the gloss of the light-sensitive material, increasing the retouchability, preventing the adhesion to each other light-sensitive material and so forth.

In the silver halide photographic light-sensitive materials of the invention, a lubricating agent may be added with the purpose of reducing a sliding friction.

In the silver halide photographic light-sensitive materials of the invention, an antistatic agent may be added with the purpose of preventing static. There are some cases where such an antistatic agent is used in an antistatic layer provided to the side of a support where no emulsion is coated, or other cases where such an antistatic agent is used in a protective layer other than the emulsion layers provided to the side of the emulsion layers and/or to the side of the support where the emulsion layers are coated.

In the silver halide photographic light-sensitive materials of the invention, the photographic emulsion layers and/or other hydrophilic colloidal layers thereof are allowed to contain a variety of surface active agents, with the purposes of improving a coatability, preventing static, improving a slidability, improving an emulsification and a dispersion, preventing an adhesion, and improving the photographic characteristics such as a development acceleration, hardening, sensitization and so forth.

In the silver halide photographic light-sensitive materials of the invention, the photographic emulsion layers and other layers thereof may be coated over to flexible reflection type supports such as a baryta paper, an α-olefin-polymer-laminated paper and the like, a synthetic paper and so forth; film supports comprising such a semisynthetic or synthetic polymer as a cellulose acetate, a cellulose nitrate, a polystyrene, a polyvinyl chloride, a polyethylene terephthalate, a polycarbonate, a polyamide and so forth; solid supports such as a glass, metal, earthware and so forth.

In the silver halide photographic light-sensitive materials of the invention, the surfaces of the support thereof may be treated, if required, by a corona discharge, UV rays irradiation, flame or the like and may then be coated directly or through a single or not less than two subbing layers which are to improve the surfaces of a support in adhesive property, antistatic property, dimensional stability, antiabrasive property, hardness, antihalation property, frictional property and/or other properties.

In the silver halide photographic light-sensitive materials of the invention, when silver halide emulsions are coated thereto, a thickening agent may be used with the purpose of improving the coatability. As for the coating processes, it is particularly advantageous to apply an extrusion coating process or a curtain coating process, because these processes are capable of applying emulsions to not less than two layers at the same time.

The light-sensitive materials of the invention can be exposed to light by making use of electromagnetic waves in the same spectral region to which the emulsion layers forming the light-sensitive material of the invention is sensitive. As for the light sources, any one of the well-known light-sources may be used, such as natural light, i.e., daylight, a tungsten lamp, a fluorescent lamp, a mercury lamp, a xenon-arc lamp, a carbon-arc lamp, a xenon flash lamp, a CRT flying spot, a variety of laser beams, an LED, a light emitted from a phosphor excited by an electron, X-ray, γ-ray, α-ray or the like beams.

An exposure may be made not only for one millisecond or shorter, for example, from 100 microseconds to one millisecond by making use of a CRT or an xenon flash lamp, but also for 10 seconds or longer, as well as from one millisecond to 10 seconds by making use of an ordinary type printer. Such an exposure may be made continuously or intermittently.

In the silver halide photographic light-sensitive materials of the invention, an image can be reproduced in any color developing processes well-known in the industry skilled in the art.

In the invention, the color developing agents which may be used in color developer include the well-known ones being popularly used in a variety of color photographic processes.

These developing agents include, for example, an aminophenol type and a p-phenylenediamine type derivatives. These compounds are more stable than in the free state thereof, therefore, they are used generally in the form of such a salt as a chloride or sulfate. These compounds are generally used in a concentration of from about 0.1 g to about 30 g and, more preferably from about 1 g to about 15 g per liter of the color developer to be used.

The aminophenol type developing agents include, for example, o-aminophenol, p-aminophenol, 5-amino-2-oxytoluene. 2-amino-3-oxytoluene, 2-oxy-3-amino-1,4-dimethylbenzene and so forth.

The particularly useful aromatic primary amine type color developing agents include, for example, an N,N'-dialkyl-p-phenylenediamine type compound in which the alkyl and phenyl groups may be substituted with any substituent, respectively. The more useful compounds among them include, for example, an N,N'-diethyl-p-phenylenediamine hydrochloride, an N-methyl-p-phenylenediamine hydrochloride, an N,N'-dimethyl-p-phenylenediamine hydrochloride, a 2-amino-5-(N-ethyl-N-dodecylamino)toluene, an N-ethyl-N-β-methanesulfonamidethyl-3-methyl-4-aminoaniline sulfatem an N-ethyl-N-β-hydroxyethylaminoaniline, a 4-amino-3-methyl-N,N'-diethylaniline, a 4-amino-N-(2-methoxyethyl)-N-ethyl-methylaniline-p-toluene sulfonate, and so forth.

The color developers applicable to the process of the silver halide photographic light-sensitive materials of the invention may be added with, besides the above-mentioned aromatic primary amine type color developing agents, any compounds which have been well known as the component compounds of developers. For example, alkalizing agents such as sodium hydroxide, sodium carbonate, potassium carbonate and so forth, an alkali-metal sulfite, an alkali-metal hydrogensulfite, an alkali-metal thiocyanate, an alkali-metal halide, a benzyl alcohol, a water-softening agent, a thickening agent and so forth may be freely added thereto.

The pH value of color developers is, normally, not lower than 7 and, most popularly, from about 10 to about 13.

The color developing temperature is, normally, not lower than 15° C. and, more popularly, within the range of from 20° C. to 50° C. It is preferable to carry out a rapid development at a temperature of not lower than 30° C. It is also preferable that the normal color developing time is, preferably, within the range of from 20 seconds to 60 seconds and, more preferably, within the range of from 30 seconds to 50 seconds.

In the silver halide photographic light-sensitive materials relating to the invention may be processed in an alkaline-activated bath, provided that the hydrophilic colloidal layers thereof contain the above-mentioned color developing agent to serve as itself or as a precursor. The color developing agent precursors are the compounds each capable of producing such a color developing agent under an alkaline condition and such precursors include, for example, a Schiff base type precursor with an aromatic aldehyde derivative, a polyvalent metal ion complex precursor, a phthalimide derivative precursor, a phosphamide derivative precursor, a sugar amine reactant precursor and a urethane type precursor. The above-mentioned precursors of aromatic primary amine type color developing agents are described in, for example, U.S. Pat. Nos. 3,342,599, 2,507,114, 2,695,234 and 3,719,492; British Patent No. 803,783; Japanese Patent O.P.I. Publication Nos. 185628/1978 and 79035/1979; and Research Disclosure Nos. 15159, 12146 and 13924; and so forth.

It is necessary to add the aromatic primary amine type color developing agents or the precursors thereof in such an amount as is capable of satisfactorily developing a color in an activation treatment. Such an amount to be added depends considerably upon the kinds of the light-sensitive materials used, and they are generally used namely in an amount within the range of from 0.1 mol to 5 mol and, more preferably, from 0.5 mol to 3 mol, per mol of the silver halide to be used therein. The above-mentioned color developing agents and the precursors thereof may be used independently or in combination.

They may be contained in a light-sensitive material after dissolving them in a suitable solvent such as water, methanol, acetone or the like, or they may also be added in the form of an emulsified dispersion prepared by dissolving them in such a high boiling organic solvent such as dibutyl phthalate, dioctyl phthalate, tricresyl phthalate or the like. Further, they may be added after impregnating them into a latex polymer, as described in Research Disclosure No. 14850.

Such a silver halide photographic light-sensitive material of the invention is color-developed and is then bleached and fixed up. The bleaching step may be carried out at the same time when the fixing step is done. As for the bleaching agents, a variety of compounds may be used for. Among them, such a polyvalent metal compounds such as iron (III), cobalt (III), copper (II) and so forth and, particularly, the complex salts of the polyvalent metal cation of the above-mentioned polyvalent metal compounds and an organic acid, including, for example, aminopolycarboxylic acids such as an ethylenediamine tetraacetic acid, a nitrilotriacetic acid, and an N-hydroxyethylethylenediamine diacetic acid; metal complex salts, ferricyanates, dichromates and so forth such as those of malonic acid, tartaric acid, malic acid, diglycolic acid, dithioglycolic acid or the like; may be used for, independently or in suitable combination.

As for the fixing agents, there uses a soluble complexing agent capable of making a silver halide being soluble to serve as a complex salt. Such soluble complexing agents include, for example, sodium thiosulfate, ammonium thiosulfate, potassium thiocyanate, thiourea, thioether and so forth.

After a fixing step, a washing step is normally carried out. In place of such a washing step, a stabilizing step may be carried out, or the both steps may also be carried out. The stabilizing agents, which may be used in such stabilizing step, are allowed to contain a pH adjusting agent, a chelating agent, an antimold and so forth. The typical conditions of containing the above-mentioned additives may be referred to Japanese Patent O.P.I. Publication No. 134636/1983 and so forth.

The silver halide photographic light-sensitive materials of the invention each having the constitution described above are capable of performing a rapid processing, displaying a proper contrast characteristics without affecting any other photographic characteristics of a dye-image formed and, being further endowed with the excellent characteristics improved in a BF contamination resistance and in a pH variation resistance.

EXAMPLES

Now, the invention will be described in detail with reference to the following embodiments. It is, however, to be understood that the invention shall not be limited thereto.

EXAMPLE-1

Preparation of silver halide emulsions

EM-1

This emulsion was prepared in such a manner that a silver nitrate solution and a sodium chloride solution was mixed up in an aqueous inert gelatin solution in a double-jet process with stirring and controlling a temperature, a pH and a pAg to keep at 60° C., pH=3.0 and pAg=7.8, respectively, and was then desalted and washed in an ordinary processes.

The resulted emulsion EM-1 was a monodisperse type emulsion which was comprised of cubic silver chloride grains having an average grain size of 0.5 μm.

EM-2

An emulsion EM-2 was prepared in such a manner that an aqueous halide solution which was comprised of a silver nitrate solution and a potassium bromide and sodium chloride solution was mixed in an aqueous inert gelatin solution in a double-jet process with stirring and controlling a temperature, a pH and a pAG to keep at 60° C., pH=3.0 and pAg=7.8, in accordance with the process described in Japanese Patent O.P.I. Publication No. 45437/1984, respectively, and was then desalted and washed in an ordinary processes.

The emulsion EM-2 was a monodisperse type emulsion which was comprised of cubic silver iodide grains having an average grain size of 0.5 μm and a silver bromide content of 0.15 mol % in the silver halide composition.

EM-3

An emulsion EM-3 was prepared in the same manner as in EM-2 and the resulted EM-3 was a monodisperse type emulsion which was comprised of tetradecahedral silver chlorobromide grains having an average grain size of 0.5 μm and a silver bromide content of 90 mol % in the silver halide composition.

Next, each of the emulsions, EM-1 through EM-3, was chemically sensitized in such a manner that a sulfur sensitization was applied by adding sodium thiosulfate in an amount of 2 mg per mol of the silver halide emulsions at 60° C. and a compound represented by the formula [S] given in Table-1 was then added when the sulfur sensitization was completed.

Resultingly, the emulsions shown in Table-1, Em-a through Em-m and Em-1 through Em-15 were prepared of the Em-1 through Em-3.

The chemically sensitized silver halide emulsions were added with the coupler dispersions shown in Table-1, respectively. The resulted emulsions were coated over to polyethylene resin-coated paper so that each of the amount of silver coated was to be 0.3 g/m$^2$ (provided however that it was to be 0.4 g/m$^2$ when MC-1 was used) in terms of metal silver contents and the gelatin coated was to be 2.0 g/m$^2$. Besides, the following compound [H-1] was used for a hardening agent.

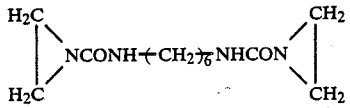

[H-1]

Coupler dispersions

Each of the coupler dispersions was prepared in such a manner that 40 g of the coupler and the hydroquinone derivative shown in Table-1 were dissolved in a mixture solvent of 10 ml of dibutyl phthalate and ethyl acetate and the resulted solution was added into an aqueous solution containing sodium dodecylbenzenesulfonate and a dispersion was made with a super-sonic homogenizer.

The couplers (YC-1), (MC-1) and (CC-1) and the comparative compounds to Compound [S] each used therein have the following formulas, respectively:

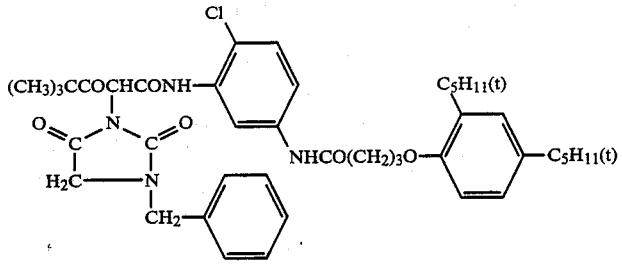

(YC-1)

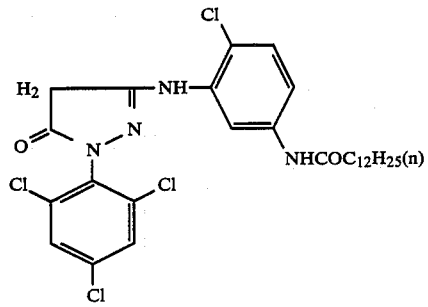

(MC-1)

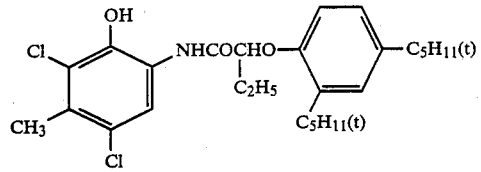

(CC-1)

-continued

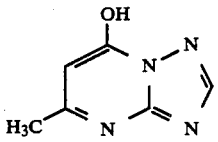

Comparative Compound-1

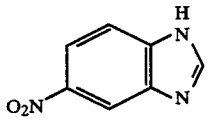

Comparative Compound-2

Each of the samples prepared was exposed to light through a wedge by making use of a sensitometer, Model KS-7 manufactured by Konishiroku Photo Industry Co., Ltd., and were then processed in accordance with the color developing steps shown below. After then, the sensitometry of each sample was measured with an optical densitometer, Model PDA-65 manufactured by Konishiroku Photo Industry Co., Ltd.

The results thereof are shown in Table-1.

In the table, γa means a value of the product of each difference between the logarithms of the exposures necessary for obtaining the densities 0.25 and 0.75 and the difference between the above-mentioned densities 0.25 and 0.75, i.e., 0.5. and such a value expresses a toe-contrast and indicates that the more this value is, the higher a contrast is.

Herein, a developing time is expressed as a time necessary for completing a development at which the development of each sample reaches a plateau state.

| [Processing steps] | Temperature | Time |
|---|---|---|
| Color developing | 34.7 ± 0.3° C. | See Table-1 |
| Bleach-fixing | 34.7 ± 0.5° C. | 50 sec. |
| Stabilizing | 30 to 34° C. | 90 sec. |
| Drying | 60 to 80° C. | 60 sec. |

-continued

| | |
|---|---|
| [Color developer-A] | |
| Pure water | 800 ml |
| Ethylene glycol | 10 ml |
| N,N—diethylhydroxylamine | 10 g |
| Potassium chloride | 2 g |
| N—ethyl-N-β-methanesulfonamidoethyl-3-methyl-4-aminoaniline sulfate | 5 g |
| Sodium tetrapolyphosphate | 2 g |
| Potassium carbonate | 30 g |
| Optical brightening agent (4,4'-diamino-stilbene disulfonic acid derivative) | 1 g |
| Pure water to be added to make a total of | 1 liter |
| pH to be adjusted to | pH 10.2 |
| [Bleach-fixer-A] | |
| Ferric ammonium ethylenediaminetetraacetic acid dihydrate | 60 g |
| ethylenediaminetetraacetic acid | 3 g |
| Ammonium thiosulfate (a 70% solution) | 100 ml |
| Ammonium sulfite (a 40% solution) | 27.5 ml |
| pH to be adjusted with potassium carbonate or glacial acetic acid to | pH 7.1 |
| Water to be added to make a total of | 1 liter |
| [Stabilizer] | |
| 5-chloro-2-methyl-4-isothiazoline-3-one | 1 g |
| 1-hydroxyethylidene-1,1-diphosphonic acid | 2 g |
| Water to be added to make a total of | 1 liter |
| pH to be adjusted with sulfuric acid or potassium hydroxide to | pH 7.0 |

TABLE 1

| Sample No. | Emulsion No. | Silver halide emulsion: Original emulsion | Compound [S]or comparative compound (mol/mol AgX) | Coupler (mol/mol AgX) | Hydroquinone derivative having Formula [I] (mol/mol coupler) | γa | Developing time (sec.) |
|---|---|---|---|---|---|---|---|
| (Comparative) 1 | Em-a | EM-3 | — | YC-1 (0.4) | HQ-4 (0.04) | 2.32 | 180 |
| (Comparative) 2 | Em-b | EM-3 | S-1 (1 × $10^{-3}$) | YC-1 (0.4) | HQ-4 (0.04) | 2.18 | 180 |
| (Comparative) 3 | Em-c | EM-1 | — | YC-1 (0.4) | HQ-4 (0.15) | 2.53 | 45 |
| (Comparative) 4 | Em-d | EM-1 | Comparative-1 (1 × $10^{-3}$) | YC-1 (0.4) | HQ-4 (0.15) | 2.55 | 45 |
| (Comparative) 5 | Em-e | EM-1 | Comparative-2 (1 × $10^{-3}$) | YC-1 (0.4) | HQ-4 (0.15) | 2.51 | 45 |
| | | | Comparative-1 (1 × $10^{-3}$) | | | | |
| (Invention) 6 | Em-f | EM-1 | S-1 (1 × $10^{-3}$) | YC-1 (0.4) | HQ-4 (0.15) | 2.10 | 45 |
| (Comparative) 7 | Em-g | EM-2 | — | YC-1 (0.4) | HQ-4 (0.15) | 2.50 | 45 |
| (Invention) 8 | Em-h | EM-2 | S-1 (1 × $10^{-3}$) | YC-1 (0.4) | HQ-4 (0.15) | 1.98 | 45 |
| (Comparative) 9 | Em-g | EM-2 | — | CC-1 (0.4) | HQ-4 (0.15) | 2.67 | 45 |
| (Invention) 10 | Em-h | EM-2 | S-1 (1 × $10^{-3}$) | CC-1 (0.4) | HQ-4 (0.15) | 2.08 | 45 |
| (Comparative) 11 | Em-g | EM-2 | — | MC-1 (0.2) | HQ-4 (0.15) | 2.69 | 45 |
| (Invention) 12 | Em-h | EM-2 | S-1 (1 × $10^{-3}$) | MC-1 (0.2) | HQ-4 (0.15) | 2.10 | 45 |
| (Invention) 13 | Em-h | EM-2 | S-1 (1 × $10^{-3}$) | MC-1 (0.2) | HQ-16 (0.15) | 2.08 | 45 |
| (Invention) 14 | Em-h | EM-2 | S-1 (1 × $10^{-3}$) | MC-1 (0.2) | HQ-30 (0.15) | 2.11 | 45 |
| (Invention) 15 | Em-h | EM-2 | S-1 (1 × $10^{-3}$) | MC-1 (0.2) | HQ-41 (0.15) | 2.03 | 45 |
| (Invention) 16 | Em-i | EM-2 | S-1 (1 × $10^{-3}$) | MC-1 (0.2) | HQ-41 (0.15) | 2.02 | 45 |
| (Invention) 17 | Em-j | EM-2 | S-23 (1 × $10^{-3}$) | MC-1 (0.2) | HQ-41 (0.15) | 2.05 | 45 |
| (Invention) 18 | Em-k | EM-2 | S-29 (1 × $10^{-3}$) | MC-1 (0.2) | HQ-41 (0.15) | 1.99 | 45 |
| (Invention) 19 | Em-l | EM-2 | S-34 (1 × $10^{-3}$) | MC-1 (0.2) | HQ-41 (0.15) | 2.04 | 45 |
| (Invention) 20 | Em-m | EM-2 | S-39 (1 × $10^{-3}$) | MC-1 (0.2) | HQ-41 (0.15) | 2.01 | 45 |
| (Invention) 21 | Em-1 | EM-2 | S-3 (1 × $10^{-3}$) | MC-1 (0.2) | HQ-41 (0.15) | 2.04 | 45 |
| (Invention) 22 | Em-2 | EM-2 | S-6 (1 × $10^{-3}$) | MC-1 (0.2) | HQ-41 (0.15) | 2.01 | 45 |
| (Invention) 23 | Em-3 | EM-2 | S-10 (1 × $10^{-3}$) | MC-1 (0.2) | HQ-41 (0.15) | 2.06 | 45 |
| (Invention) 24 | Em-4 | EM-2 | S-12 (1 × $10^{-3}$) | MC-1 (0.2) | HQ-41 (0.15) | 2.05 | 45 |
| (Invention) 25 | Em-5 | EM-2 | S-15 (1 × $10^{-3}$) | MC-1 (0.2) | HQ-41 (0.15) | 1.99 | 45 |
| (Invention) 26 | Em-6 | EM-2 | S-18 (1 × $10^{-3}$) | MC-1 (0.2) | HQ-41 (0.15) | 1.96 | 45 |
| (Invention) 27 | Em-7 | EM-2 | S-21 (1 × $10^{-3}$) | MC-1 (0.2) | HQ-41 (0.15) | 1.97 | 45 |

TABLE 1-continued

| Sample No. | | Silver halide emulsion: Emulsion No. | Original emulsion | Compound [S]or comparative compound (mol/mol AgX) | Coupler (mol/mol AgX) | Hydroquinone derivative having Formula [I] (mol/mol coupler) | γa | Developing time (sec.) |
|---|---|---|---|---|---|---|---|---|
| (Invention) | 28 | Em-8 | EM-2 | S-25 ($1 \times 10^{-3}$) | MC-1 (0.2) | HQ-41 (0.15) | 2.01 | 45 |
| (Invention) | 29 | Em-9 | EM-2 | S-31 ($1 \times 10^{-3}$) | MC-1 (0.2) | HQ-41 (0.15) | 1.98 | 45 |
| (Invention) | 30 | Em-10 | EM-2 | S-33 ($1 \times 10^{-3}$) | MC-1 (0.2) | HQ-41 (0.15) | 2.07 | 45 |
| (Invention) | 31 | Em-11 | EM-2 | S-34 ($1 \times 10^{-3}$) | MC-1 (0.2) | HQ-41 (0.15) | 2.04 | 45 |
| (Invention) | 32 | Em-12 | EM-2 | S-35 ($1 \times 10^{-3}$) | MC-1 (0.2) | HQ-41 (0.15) | 2.02 | 45 |
| (Invention) | 33 | Em-13 | EM-2 | S-36 ($1 \times 10^{-3}$) | MC-1 (0.2) | HQ-41 (0.15) | 2.00 | 45 |
| (Invention) | 34 | Em-14 | EM-2 | S-38 ($1 \times 10^{-3}$) | MC-1 (0.2) | HQ-41 (0.15) | 2.07 | 45 |
| (Invention) | 35 | Em-15 | EM-2 | S-41 ($1 \times 10^{-3}$) | MC-1 (0.2) | HQ-41 (0.15) | 1.98 | 45 |

As is obvious from Table-1, Samples 1 and 2 are not suitable for a rapid processing, because they use an emulsion having a 90 mol % silver bromide content. In comparison of Sample 1 with Sample 2, the effect of the compound [S] is not so remarkably displayed. Samples 3 through 35 each using an emulsion having a 90 mol% or higher silver chloride content may basically be able to satisfactorily perform a raid processing, however, comparative samples 3 to 5, 7, 9 and 11 may not be put into practical use, because a γa value is made greater, i.e., a toe-contrast is seriously hardened, by the compound represented by Formula [I]. On the contrary, the excellent contrast characteristics each proved to be displayed with the samples of the invention, Samples 6, 8, 10 and 12 through 35, each using the compound of Formula [I] and the compound [S] of the invention in combination. To be more precise, the emulsions each containing a small amount of silver bromide result in a more greater effect of the compound [S].

EXAMPLE-2

Preparation of Em-n through Em-q and Em-oq.

These emulsions were prepared in such a manner that Em-2 which had been prepared in Example-1 was added with chloroauric acid in an amount of $5 \times 10^{-5}$ mol per mol of the silver halide used and, one minute later, sodium thiosulfate was then added thereto in an amount of 2 mg per mol of the silver halide so as to apply a chemical sensitization and, after completion of the chemical sensitization, a compound represented by Formula [S] shown in Table-2 was added so as to prepare the objective emulsions.

Each of the prepared emulsions was coated over in the same manner as in Example-1 to prepare the respective samples and each of the compounds shown in Table-2 was also added thereto in the course of the coating process so as to serve as a hardening agent.

The resulted samples were tested for the following evaluations:

[BF contamination resistance test]

A color developer [B] was prepared in such a manner that the bleach-fixer [A] used in Example-1 was added to the color developer [A] used also in Example-1 in a proportion of 1.0 ml of the former to 1 liter of the latter.

Each of the samples was processed with the color developer [B] in accordance with the color processing steps described in Example-1 and the sensitometric measurements of the samples were tried, respectively.

The results thereof are shown in Table-2. In the table, Δγb is the value of a contrast variation range obtained in the case of processing the samples with a color developer [B] into which a bleach-fixer was contaminated and such contrast variation values are expressed in accordance with the value of contrast (γb) as the standard value obtained in the case of processing samples with color developer [A] without contaminated with any bleach-fixer. The less such a value is, the more such a BF contamination resistance is excellent.

A value of γb expressed herein means a value expressed by a products of the reciprocal of a logarithmic difference of each exposure necessary to obtain the densities of 0.8 and 1.8 and the above-mentioned density difference. The more this value is, the more a contrast is hard.

[pH variation resistance test]

A color developer [C] was so prepared as to have the same composition as in the above-mentioned color developer [A] and as to be adjusted to have a pH value of 10.6. The samples were processed with the color developer [C] in accordance with the color processing steps described in Example-1 and the sensitometric measurements of the processed samples were tried.

The results thereof are shown in Table-2. In the table, Δγb is the value of a contrast variation range obtained in the case of processing the samples with color developer [C] having a pH value of 10.6 and such contrast variation values are expressed in accordance with the value of a contrast (γ) as the standard value in the case of processing them with color developer [A] having a pH value of 10.2.

A value of γb expressed herein means a value expressed by a products of the reciprocal of a logarithmic difference of each exposure necessary to obtain the densities of 0.8 and 1.8 and the above-mentioned density difference. The more this value is, the more a contrast is hard.

TABLE-2

| Sample No. | | Silver halide emulsion | Compound having Formula [S] (mol/mol AgX) | Coupler (mol/mol AgX) | Hydroquinone derivative having Formula [I] (mol/mol coupler) | Hardener | BF contam. resistance Δγb | pH variation resistance Δγb |
|---|---|---|---|---|---|---|---|---|
| (Comparative) | 36 | Em-d | Comparative compound-1 ($1 \times 10^{-3}$) | MC-1 (0.2) | HQ-41 (0.05) | H-1 | 0.95 | 0.78 |
| (Invention) | 17 | Em-j | S-23 ($1 \times 10^{-3}$) | MC-1 (0.2) | HQ-41 (0.05) | H-1 | 0.58 | 0.64 |

TABLE-2-continued

| Sample No. | | Silver halide emulsion | Compound having Formula [S] (mol/mol AgX) | | Coupler (mol/mol AgX) | Hydroquinone derivative having Formula [I] (mol/mol coupler) | Hardener | BF contam. resistance Δγb | pH variation resistance Δγb |
|---|---|---|---|---|---|---|---|---|---|
| (Invention) | 18 | Em-k | S-29 | $(1 \times 10^{-3})$ | MC-1 (0.2) | HQ-41 (0.05) | H-1 | 0.60 | 0.60 |
| (Invention) | 15 | Em-h | S-1 | $(1 \times 10^{-3})$ | MC-1 (0.2) | HQ-41 (0.05) | H-1 | 0.41 | 0.61 |
| (Invention) | 16 | Em-i | S-7 | $(1 \times 10^{-3})$ | MC-1 (0.2) | HQ-41 (0.05) | H-1 | 0.42 | 0.57 |
| (Invention) | 37 | Em-n (Gold-added emulsion) | S-1 | $(1 \times 10^{-3})$ | MC-1 (0.2) | HQ-41 (0.05) | H-1 | 0.29 | 0.55 |
| (Invention) | 38 | Em-o (Gold-added emulsion) | S-7 | $(1 \times 10^{-3})$ | MC-1 (0.2) | HQ-41 (0.05) | H-1 | 0.31 | 0.54 |
| (Invention) | 39 | Em-n (Gold-added emulsion) | S-7 | $(1 \times 10^{-3})$ | MC-1 (0.2) | HQ-41 (0.05) | HD-2 | 0.18 | 0.49 |
| (Invention) | 40 | Em-o (Gold-added emulsion) | S-7 | $(1 \times 10^{-3})$ | MC-1 (0.2) | HQ-41 (0.05) | HD-2 | 0.19 | 0.50 |
| (Invention) | 19 | Em-l | S-34 | $(1 \times 10^{-3})$ | MC-1 (0.2) | HQ-41 (0.05) | H-1 | 0.79 | 0.39 |
| (Invention) | 20 | Em-m | S-39 | $(1 \times 10^{-3})$ | MC-1 (0.2) | HQ-41 (0.05) | H-1 | 0.81 | 0.36 |
| (Invention) | 41 | Em-p (Gold-added emulsion) | S-34 | $(1 \times 10^{-3})$ | MC-1 (0.2) | HQ-41 (0.05) | H-1 | 0.73 | 0.25 |
| (Invention) | 42 | Em-q (Gold-added emulsion) | S-39 | $(1 \times 10^{-3})$ | MC-1 (0.2) | HQ-41 (0.05) | H-1 | 0.75 | 0.24 |
| (Invention) | 43 | Em-p (Gold-added emulsion) | S-34 | $(1 \times 10^{-3})$ | MC-1 (0.2) | HQ-41 (0.05) | HD-2 | 0.70 | 0.11 |
| (Invention) | 44 | Em-q (Gold-added emulsion) | S-39 | $(1 \times 10^{-3})$ | MC-1 (0.2) | HQ-41 (0.05) | HD-2 | 0.68 | 0.13 |
| (Invention) | 45 | Em-oq (Gold-added emulsion) | S-7<br>S-39 | $(5 \times 10^{-4})$<br>$(5 \times 10^{-4})$ | MC-1 (0.2) | HQ-41 (0.05) | HD-2 | 0.26 | 0.21 |

It is obvious from the table that the following advantages can be displated. Namely, every sample of the invention, 15 to 20 and 37 to 45, are excellent in both BF contamination resistance and pH variation resistance, as compared with the comparative sample 36 containing the comparative compound [S]. To be more detail, the compounds represented by Formula [SA] display an excellent effect on BF contamination resistance and the compounds represented by Formula [SB] display an excellent effect on pH variation resistance. Besides the above, the samples each containing the silver halide emulsion of the invention to which a gold compound is added are more efficient in the above-mentioned effects and the samples hardened by making use of a chlorotriazine type compound as a hardening agent are also efficient therein. Further, out of the compounds represented by Formula [SA], the compounds having an oxygen atom represented by Z in particular display more excellent effects, as compared with those having a sulfur atom represented by Z.

EXAMPLE-3

The sample emulsions shown in Table-3 were prepared, respectively, in such a manner that the emulsion, EM-2, was added with a chloroauric acid in an amount of $5 \times 10^{-5}$ mol per mol of the silver halide used therein at 60° C. and, 1 minute later, sodium thiosulfate was then added in an amount of 2 mg per mol of the silver halide and the resulted emulsions were chemically sensitized. Five minutes before the completion of the chemical sensitization, the spectral sensitizers (sensitizing dyes) shown in Table-3 were added thereto and, after completion of the chemical sensitization, the compounds represented by Formula [S] shown in Table-3 were then added. The resulted emulsions are shown in Table-3 below.

TABLE-3

| Sample No. | Spectral sensitizer | Compound having Formula [S] |
|---|---|---|
| Em-r | [SD-1] | Comparative compound-1 |
| Em-s | [SD-2] | Comparative compound-1 |
| Em-t | [SD-3] | Comparative compound-1 |
| Em-u | [SD-1] | S-10 |
| Em-v | [SD-2] | S-10 |
| Em-w | [SD-3] | S-10 |
| Em-x | [SD-1] | S-39 |
| Em-y | [SD-2] | S-39 |
| Em-z | [SD-3] | S-39 |

[SD-1]

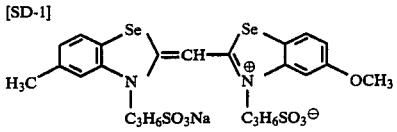

[SD-2]

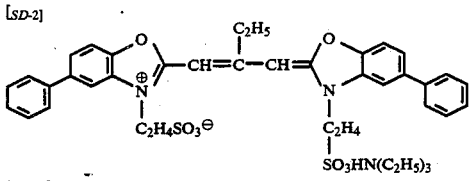

[SD-3]

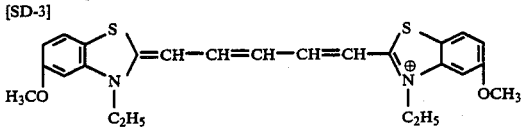

Next, a multilayered silver halide color photographic light-sensitive material sample No. 46 was prepared in such a manner that the layer arrangement shown in Table-4 was provided onto a polyethylene resin-coated paper in order.

Also, the similar sample No. 47 having the same constitution as that of Sample No. 46 was prepared in the same manner as in Sample No. 46, except that HQ-4 was added into the 1st, 3rd and 5th layers in an amount of 0.1 mol per mol of the couplers used, respectively.

Further, Sample No. 48 was prepared in the same manner as in Sample No. 47, except that the blue-sensitive emulsion used in the 1st layer of Sample No. 47 was replaced by Em-u, the green-sensitive emulsion of the 3rd layer thereof was replaced by Em-v and the red-sensitive emulsion in the 5th layer thereof was replaced by Em-w, respectively.

Still further, Sample No. 49 was prepared in the same manner as in Sample No. 48, except that the blue-sensitive emulsion of the 1st layer of Sample No. 48 was replaced by Em-x, the green-sensitive emulsion of the 3rd layer thereof was replaced by Em-y and the red-sensitive emulsion of the 5th layer thereof was replaced by Em-z, respectively. Into every Sample of No. 46 through No. 49, exemplified compound [HD-2] was added in an amount of 10 mg per g of gelatin used.

TABLE-4

| Layer | Composition |
|---|---|
| 7th layer | Gelatin (1.0 g/m$^2$) |
| 6th layer | UV absorbing agent (UV-1, 0.3 g/m$^2$)<br>Gelatin (0.7 g/m$^2$) |
| 5th layer | Red-sensitive silver chlorobromide emulsion (Em-t, Silver coated: 0.25 g/m$^2$)<br>Cyan coupler (CC-1, 0.3 g/m$^2$)<br>Dibutyl phthalate (0.2 g/m$^2$)<br>Gelatin (1.0 g/m$^2$) |
| 4th layer | UV absorbing agent (UV-1, 0.7 g/m$^2$)<br>Gelatin (1.3 g/m$^2$) |
| 3rd layer | Green-sensitive silver chlorobromide emulsion (Em-s, Silver coated: 0.35 g/m$^2$)<br>Magenta coupler (MC-1, 0.4 g/m$^2$)<br>Dibutyl phthalate (0.2 g/m$^2$)<br>Gelatin (1.5 g/m$^2$) |
| 2nd layer | Gelatin (1.0 g/m$^2$) |
| 1st layer | Blue-sensitive silver chlorobromide emulsion (Em-y, Silver coated: 0.40 g/m$^2$) |
| | Support |

UV absorbing agent (UV-1)

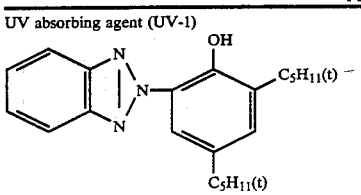

The sensitometric evaluation of each resulted sample was made in accordance with the method described in Example-1 and the following color turbidity tests thereof were also tried, respectively.

The results thereof are shown in Table-5.

<Color turbidity evaluation>

Every resulted sample was exposed to blue-light through an optical wedge and was then color processed in accordance with the method described in Example-1. The density measurement thereof was carried out, in which a green density obtained when a blue density was 1.0 was designated as $D_G$.

The yellow dyes formed of the yellow couplers have some absorption in the green spectral region. Therefore, the equation, $D_G=0$, is not established even if no color turbidity is produced at all, but $D_G$ was of the order of about 0.2 in the evaluation system of the invention. However, when a density $D_G$ is higher than that of the order of about 0.2, it is suggested that a color turbidity is caused by diffusing the oxidized products of a color developing agent produced in a blue-sensitive emulsion layer into a green-sensitive emulsion layer.

TABLE-5

| | | Silver halide emulsion | Compound having Formula [S] (mol/mol AgX) | | Hydroquinone derivative having Formula [I] (mol/mol coupler) | γa | DG |
|---|---|---|---|---|---|---|---|
| 46 | B | Em-r | Comp. compound-1 | (1 × 10$^{-3}$) | — | 2.04 | |
| (Comparative) | G | Em-s | Comp. compound-1 | (1 × 10$^{-3}$) | — | 2.07 | 0.56 |
| | R | Em-t | Comp. compound-1 | (1 × 10$^{-3}$) | — | 2.11 | |
| 47 | B | Em-r | Comp. compound-1 | (1 × 10$^{-3}$) | HQ-4 (0.1) | 2.45 | |
| (Comparative) | G | Em-s | Comp. compound-1 | (1 × 10$^{-3}$) | HQ-4 (0.1) | 2.48 | 0.22 |
| | R | Em-t | Comp. compound-1 | (1 × 10$^{-3}$) | HQ-4 (0.1) | 2.50 | |
| 48 | B | Em-u | S-10 | (1 × 10$^{-3}$) | HQ-4 (0.1) | 2.00 | |
| (Invention) | G | Em-v | S-10 | (1 × 10$^{-3}$) | HQ-4 (0.1) | 1.99 | 0.21 |
| | R | Em-w | S-10 | (1 × 10$^{-3}$) | HQ-4 (0.1) | 2.02 | |
| 49 | B | Em-x | S-39 | (1 × 10$^{-3}$) | HQ-4 (0.1) | 2.03 | |
| (Invention) | G | Em-y | S-39 | (1 × 10$^{-3}$) | HQ-4 (0.1) | 1.98 | 0.21 |
| | R | Em-z | S-39 | (1 × 10$^{-3}$) | HQ-4 (0.1) | 2.03 | |

As is obvious from Table-5, with respect to Sample No. 46 in which the comparative compound of the compounds [S] was used but any compound represented by Formula [I] was not used, a serious color turbidity was found, therefore, it cannot be put into practical use. With respect to Sample No. 47 in which the compound represented by Formula [I] was used, the toe-contrast is seriously hardened, while a color turbidity can be improved, therefore, it cannot also be put into practical use. On the other hand, it can be found that, with respect to Samples 48 and 49 each of the invention in which the compound represented by Formula [I] and the compound [S] are used in combination, a color turbidity production can be inhibited and the excellent toe-contrast characteristics can also be displayed.

What is claimed is:

1. A silver halide photographic light-sensitive material comprising a support bearing thereon at least one silver halide emulsion layer containing a dye-forming coupler and a compound represented by the following Formula [I], wherein at least one of said silver halide emulsion layers contains silver halide grains having a silver chloride content of not less than 90 mol % and a compound represented by the following Formula [S];

Formula [I]

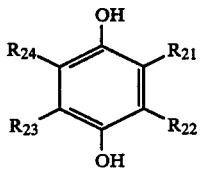

wherein, $R_{21}$, $R_{22}$, $R_{23}$ and $R_{24}$ are independently selected from the group consisting of a hydrogen atom, a halogen atom, an alkyl group, an alkenyl group, an aryl group, a cycloalkyl group, an alkoxy group, an aryloxy group, an alkylthio group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group, provided that at least one of $R_{21}$ and $R_{23}$ is a group having a total carbon atoms of not less than three);

Formula [S]

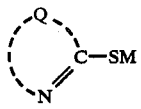

wherein Q represents a group of atoms necessary for completing a 1,3,4-oxadiazole ring, a 1,3,4-thiadiazole ring or a 1,3,5-triazine ring; and M represents a hydrogen atom, an alkali metal atom or an ammonium group.

2. The silver halide photographic light-sensitive material of claim 1, wherein the compound represented by [S] is selected from the compound represented by formula [SA];

Formula [SA]

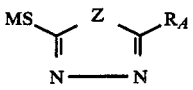

wherein Z represents an oxygen atom or a sulfur atom; $R_A$ is selected from the group consisting of a hydrogen atom, an alkyl group, an aryl group, an alkenyl group, a cycloalkyl group, a $—SR_{A1}$ group,

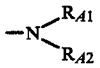

group, a $—NHCOR_{A3}$ group, a $—NHSO_2R_{A4}$ group and a heterocyclic group, in which $R_{A1}$ and $R_{A2}$ are independently selected from the group consisting of a hydrogen atom, an alkyl group and an aryl group, $R_{A3}$ and $R_{A4}$ are independently selected from the group consisting of an alkyl group or an aryl group, and M is selected from the group consisting of a hydrogen atom, an alkali metal atom and an ammonium group.

3. The silver halide photographic light-sensitive material of claim 1, wherein the compound represented by [S] is selected from the compound represented by formula [SB];

Formula [SB]

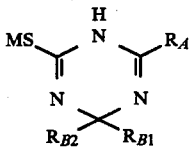

wherein $R_A$ is selected from the group consisting of a hydrogen atom, an alkyl group, an aryl group, an alkenyl group, a cycloalkyl group, a $—SR_{A1}$ group,

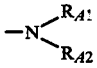

group, a $—NHCOR_{A3}$ group, a $—NHSO_2R_{A4}$ group and a heterocyclic group, in which $R_{A1}$ and $R_{A2}$ are independently selected from the group consisting of a hydrogen atom, an alkyl group and an aryl group, $R_{A3}$ and $R_{A4}$ are independently selected from the group consisting of an alkyl group or an aryl group, and M is selected from the group consisting of a hydrogen atom, an alkali metal atom and an ammonium group; $R_{B1}$ and $R_{B2}$ are independently selected from the group consisting of a hydrogen atom, an alkyl group and an aryl group.

4. The silver halide photographic light-sensitive material of claim 2, wherein Z is an oxygen atom.

5. The silver halide photographic light-sensitive material of claim 1, wherein silver halide grains contain silver bromide at a proportion of 0.05 to 5 mol %.

6. The silver halide photographic light-sensitive material of claim 1, wherein said silver halide grains contain a gold compound.

7. The silver halide photographic light-sensitive material of claim 1, wherein said silver halide grains contain said gold compound in an amount of from $10^{-8}$ mol to $10^{-1}$ mol per mol of silver halide.

8. The silver halide photographic light-sensitive material of claim 1, wherein said silver halide grains contain said gold compound in an amount of from $10^{-7}$ mol to $10^{-2}$ mol per mol of silver halide.

9. The silver halide photographic light-sensitive material of claim 6, wherein said gold compound is selected from the group consisting of a potassium chloroaurate, an auric trichloride, a potassium auric thiocyanate, a potassium iodoaurate, a tetracyanauric azide, an ammonium aurocyanate, a pyridyltrichloroaurate, an auric sulfide, and an auric selenide.

10. The silver halide photographic light-sensitive material of claim 1, wherein said compound represented by [I] is selected from the compound represented by formula [II] or [III];

Formula [II]

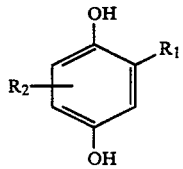

wherein $R_1$ and $R_2$ are independently selected from the group consisting of an alkyl group, an aryl group, an alkenyl group, a cycloalkyl group and a heterocyclic group;

Formula [III]

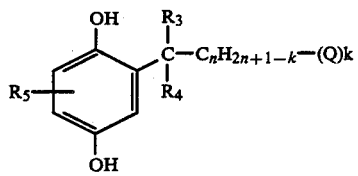

$R_3$ and $R_4$ are independently selected from the group consisting of an alkyl group having 1 to 5 carbon atoms, $R_5$ is selected from the group consisting of an alkyl group an aryl group, an alkenyl group. a cycloalkyl group and a heterocyclic group, and a group represented by the formula

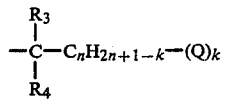

wherein n is an integer of from 1 to 20; k is an integer of 1 or 2; and Q is selected from the group consisting of a $—COXR_6$ group, in which X represents an oxygen atom or

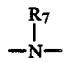

group in which $R_6$ is selected from the group consisting of a hydrogen atom, an alkyl group, an alkenyl group, a cycloalkyl group and an aryl group, $R_7$ is selected from the group consisting of a hydrogen atom, an alkyl group and an aryl group; an —OY group, in which Y represents the same as $—R_6$, or a $—COR_6$ group;

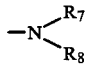

in which $R_8$ is selected from the group consisting of a hydrogen atom, an alkyl group, an aryl group or a $—COR_6$ group; a $—P(O)(OR_6)$ $([O]_lR_9)$ group, in which $R_9$ is synonymous with $R_6$ and l is an integer of 0 or 1; and a cyano group.

11. The silver halide photographic light-sensitive material of claim 1, wherein said dye-forming coupler is a yellow dye-forming coupler represented by the Formula [Y];

Formula [Y]

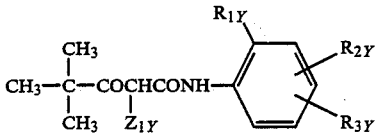

wherein $R_{1Y}$ is selected from the group consisting of a halogen atom or an alkoxy group; $R_{2Y}$ is selected from the group consisting of a hydrogen atom, a halogen atom or an alkoxy group; $R_{3Y}$ is selected from the group consisting of an acylamino group, an alkoxycarbonyl group, an alkylsulfamoyl group, an arylsulfamoyl group, an arylsulfonamido group, an alkylureido group, an arylureido group, a succinimido group, an alkoxy group or an aryloxy group; and $Z_{1Y}$ represents a group capable of splitting off upon coupling reaction with an oxidized product of a color developing agent.

12. The silver halide photographic light-sensitive material of claim 1, wherein said dye-forming coupler is a magenta dye-forming coupler represented by the Formula [P] or [a]:

Formula [P]

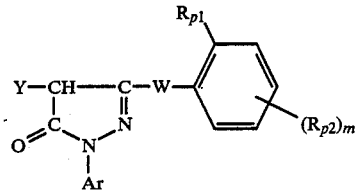

wherein Ar is an aryl group; $R_{p1}$ is selected from a group consisting of a hydrogen atom and a substituent; $R_{p2}$ represents a substituent; Y is selected from the group consisting of a hydrogen atom or a group capable of splitting off upon reaction with the oxidized product of a color developing agent; W is —NH— group or —NHCO— group in which N atom is to couple to a carbon atom of a pyrazolone nucleus, or —NH-CONH—; and m is an integer of 1 or 2;

Formula [a]

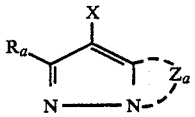

wherein Za represents a group of atoms necessary for completing a nitrogen-containing heterocyclic ring, provided that the ring completed with Za may have a substituent; X represents a hydrogen atom or a group capable of splitting off upon reaction with the oxidized product of a color developing agent; and Ra is selected from the group consisting of a hydrogen atom or a substituent selected from the group consisting of a halogen atom, an alkyl group a cycloalkyl group, an alkenyl group, a cycloalkenyl group, an alkinyl group, an aryl group, a heterocyclic group, an acyl group, a sulfonyl group, a sulfinyl group, a sulfonyl group, a carbamoyl group, a sulfamoyl group, a cyano group, a spiro-compound residual group, an organic hydrocarbon compound residual group, an alkoxy group, an aryloxy group, a heterocyclic oxy group, a siloxy group, an acyloxy group, a carbamoyloxy group, amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

13. The silver halide photographic light-sensitive material of claim 1, wherein said dye-forming coupler is a cyan dye-forming coupler represented by the Formula [E] or [F];

Formula [E]

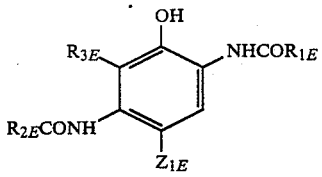

wherein $R_{1E}$ is selected from the group consisting of an aryl group, a cycloalkyl group and a heterocyclic group; $R_{2E}$ represents an alkyl group or a phenyl group; $R_{3E}$ represents a hydrogen atom, a halogen atom, an alkyl group or an alkoxy group; and $Z_{1E}$ represents a hydrogen atom or a group capable of splitting off upon reaction with the oxidized product of an aromatic primary amine type color developing agent;

Formula [F]

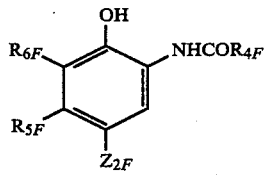

wherein $R_{4F}$ represents an alkyl such as a methyl group, an ethyl group, a propyl group, a butyl group, a nonyl group and so forth; $R_{5F}$ represents an alkyl group such as a methyl group, an ethyl group and so forth; $R_{6F}$ represents a hydrogen atom, a halogen atom such as a fluorine atom, a chlorine atom, a bromine atom and so forth, or an alkyl group such as a methyl group, an ethyl group and so forth; and $R_{2F}$ represents a hydrogen atom or a group capable of splitting off upon reaction with the oxidized product of an aromatic primary amine type color developing agent.

14. The silver halide photographic light-sensitive material of claim 1, wherein said silver halide emulsion layer is hardened by the use of a chlorotriazine hardening agents represented by the following formula [HDA] or [HDB];

Formula [HDA]

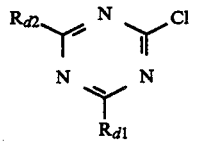

wherein $R_{d1}$ is selected from the group consisting of a chlorine atom, a hydroxy group, an alkyl group, an alkoxy group, an alkylthio group, an —OM group in which M represents a monovalent metal atom, an —NR'R" group in which R' and R" are independently selected from the group consisting of a hydrogen atom, an alkyl group and an aryl group, and a —NHCOR'" group in which R'" is independently selected from the group consisting of a hydrogen atom, an alkyl group or an aryl group; and $R_{d2}$ represents a group synonymous with the above-mentioned $R_{d1}$ except a chlorine atom;

Formula [HDB]

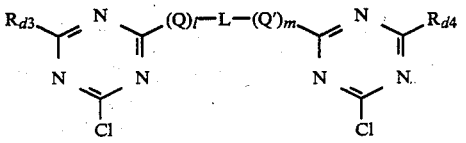

wherein $R_{d3}$ and $R_{d4}$ are independently selected from the group consisting of a chlorine atom, a hydroxy group, an alkyl group, an alkoxy group or an —OM group in which M represents a monovalent metal atom; Q and Q' independently represent a bonding group indicating —O—, —S— or —NH—; L is an alkylene group or an arylene group; and p and q are an integer of 0 or 1.

* * * * *